US006758759B2

(12) United States Patent
Gobush et al.

(10) Patent No.: US 6,758,759 B2
(45) Date of Patent: Jul. 6, 2004

(54) LAUNCH MONITOR SYSTEM AND A METHOD FOR USE THEREOF

(75) Inventors: William Gobush, North Dartmouth, MA (US); Douglas C. Winfield, Mattapoisett, MA (US); Diane I. Pelletier, Fairhaven, MA (US); Charles A. Days, South Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 426 days.

(21) Appl. No.: 09/782,278

(22) Filed: Feb. 14, 2001

(65) Prior Publication Data

US 2002/0155896 A1 Oct. 24, 2002

(51) Int. Cl.[7] ..... A63B 69/36
(52) U.S. Cl. ..... 473/131; 473/141
(58) Field of Search ..... 473/131, 150–156, 473/140–141, 219–226; 434/247, 252, 257

(56) References Cited

U.S. PATENT DOCUMENTS 4,063,259 A 12/1977 Lynch et al. ..... 354/120
4,136,387 A 1/1979 Sullivan et al. ..... 364/410
4,713,686 A * 12/1987 Ozaki et al. ..... 348/157
5,342,054 A * 8/1994 Chang et al. ..... 473/156
5,471,383 A 11/1995 Gobush et al. ..... 364/410
5,575,719 A * 11/1996 Gobush et al. ..... 473/223
6,011,359 A 1/2000 Days ..... 315/241
6,042,483 A * 3/2000 Katayama ..... 473/199
6,241,622 B1 6/2001 Gobush et al. ..... 473/199
6,431,990 B1 * 8/2002 Manwaring ..... 473/199
6,565,448 B2 * 5/2003 Cameron et al. ..... 473/131

* cited by examiner

*Primary Examiner*—Kim Nguyen
(74) *Attorney, Agent, or Firm*—Swidler Berlin Shereff Friedman, LLP

(57) ABSTRACT

The present invention is directed to a launch monitor system that measures club motion data and ball motion data. The system includes a club monitor and a ball monitor. The club monitor obtains images of the club before impact with the ball, and the ball monitor takes images of the ball after impact during a single swing. The present invention further includes a method of monitoring a club and ball in a single swing.

23 Claims, 14 Drawing Sheets

LAUNCH MONITOR SYSTEM AND A METHOD FOR USE THEREOF

TECHNICAL FIELD OF THE INVENTION

The present invention relates to sports objects, and more particularly relates to an improved launch monitor system for analyzing two sports objects in a single swing, and a method for the use thereof.

BACKGROUND OF THE INVENTION

Athletes, and particularly golfers, are interested in improving their game performance. One of the elements in golf performance in the through-the-air carry distance and the directional accuracy resulting from the golf drive. Golf ball manufacturers can predict the landing point of a driven golf ball with great accuracy if they are given values for ball velocity, flight direction and ball spin in the immediate post-launch time period. In addition, manufacturers can diagnose problems in the golfer's swing if they are given the velocity, direction and rotary motions of the golf club head in the immediate pre-launch time period.

There are known monitoring devices for determining the position of a plurality of points on a single moving object at two closely spaced points in time which can be used to provide the required data useable in making such performance predictions. These systems have drawbacks with at least portability and/or accuracy.

A need, however, exists for a launch monitor system for capturing club motion data and ball motion data in a single swing, where the system is portable, easy to use, accurate and for use outdoors.

SUMMARY OF THE INVENTION

Broadly, the present invention comprises a launch monitor system and a method for use thereof, which analyses two separate sports objects in one swing such as a golf club and a golf ball.

According to one embodiment of the present invention the launch monitor system for measuring data for a club and a ball moving in a predetermined field-of-view includes at least one club camera, at least one ball camera, and a computer. The club and ball cameras are pointed toward the predetermined field-of-view. The club camera is positioned in a first plane and the ball camera is position in a second plane spaced vertically from the first plane. Each club camera obtains at least two club images in the predetermined field-of-view. Each ball camera obtains at least two ball images in the predetermined field-of-view. The computer determines club motion data from the club images and ball motion data from the ball images.

In one embodiment, the system further includes at least two club cameras and at least two ball cameras. In another embodiment, the system further includes at least one strobe light associated with each of the club and ball cameras.

According to one aspect of the present invention, the club and ball motion data is at least two-dimensional and preferably three-dimensional.

According to another embodiment of the present invention, the system includes the club and ball cameras pointed toward the predetermined field-of-view and the computer. The club and ball cameras are located on the same side of the club and ball. The computer determines club motion data from the club images and ball motion data from the ball images.

According to one feature of the above embodiments, the club includes at least two contrasting areas thereon and the ball includes at least one contrasting area thereon, and the club images include at least all of the club contrasting areas and the ball images include at least all of the ball contrasting areas.

According to the method of the present invention, the method comprising the steps of a golfer swinging a club to impact a ball; obtaining at least two club images during the swing at two different times; obtaining at least two ball images at two different times during the swing; determining the club motion data from the club images; and determining the ball motion data from the ball images.

Preferably, the club images are obtained before the club impacts the ball and the ball images are obtained after the club impacts the ball.

In this method, the step of determining the club motion data includes determining at least one of the following: speed, acceleration, loft angle, attack angle, path angle, face angle, droop angle, loft spin, face spin, droop spin, and hit location. In this method, the step of determining the ball motion data includes determining at least one of the following: velocity, launch angle, backspin, side angle, side spin rifling spin, carry distance, direction, and carry and roll distance.

In the method, the images of the club can be obtained during a downswing, a back swing or both.

Preferably, the club and ball data obtained can be used for individual players or groups of players in club design based on swings, for fitting club specifications, and to optimize the biomechanics of a player or a group of players.

DESCRIPTION OF THE PREFERRED EMBODIMENT

Figure 1:
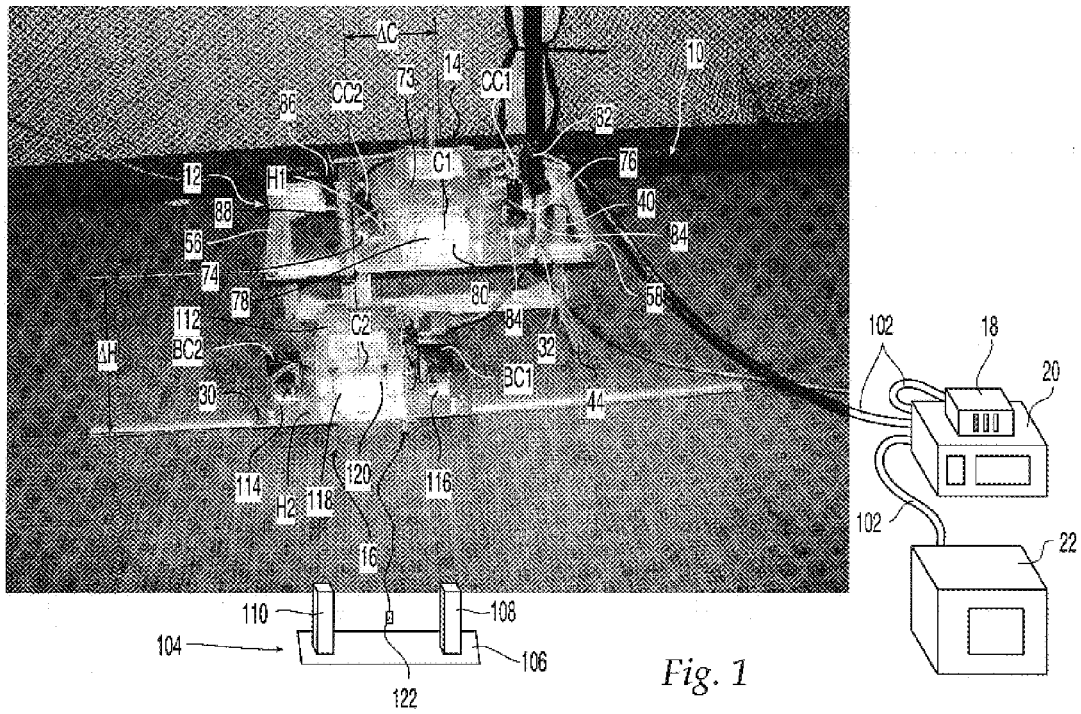
FIG. 1 is a perspective view of one embodiment of a launch monitor system of the present invention that includes a club monitor and a ball monitor.

FIG. 1 illustrates a preferred launch monitor system 10 of the invention. The launch monitor system 10 includes a support structure 12, club monitor 14, a ball monitor 16, a microprocessor 18, a computer 20, and a monitor 22. The microprocessor 18 and computer 20 are shown as separate units but may be combined into a single element. Similarly, the computer 20 and monitor 22 are shown as separate units but may be combined into a single element. The microprocessor 18 and computer 20 have several algorithms and programs used by the system to control the system and make the determinations, as discussed below.

Figure 2:
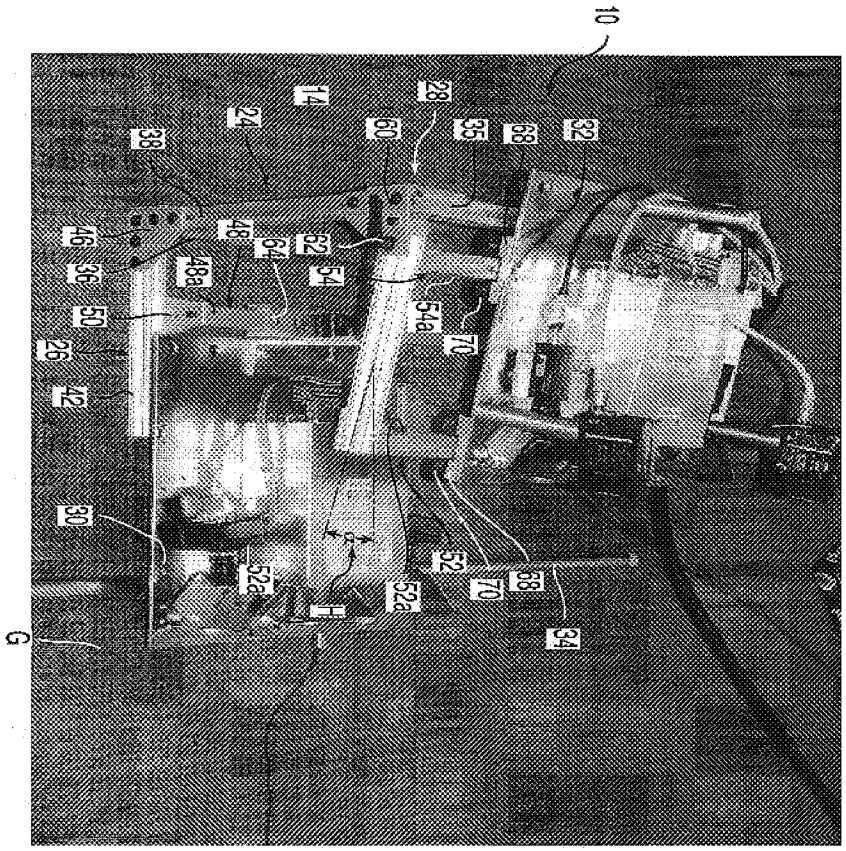
FIG. 2 is an enlarged, side, perspective view of the launch monitor system of FIG. 1.

Referring to FIGS. 1 and 2, the support structure 12 includes a rear frame 24, a lower frame subassembly 26, an upper frame assembly 28, a lower base 30, an upper base 32, and a rod 34. The rear frame 24 includes two parallel horizontal frame members 35 and 36 spaced apart and two parallel vertical frame members 38 and 40 (as shown in FIG. 1) spaced apart. These members 35–40 are fastened together to form a rectangle.

The lower frame subassembly 26 includes two frame members 42 and 44 connected to the vertical frame members 38 and 40, respectively, with braces 46 and fasteners so that the members 42 and 44 extend substantially perpendicular to members 38 and 40, respectively. The lower frame subassembly 26 further includes a member 48 that extends between the members 42 and 44 and is connected thereto with braces 50 and fasteners so that the member 48 is spaced vertically from the members 42 and 44. The member 48 includes grooves 48*a* in its front and rear faces.

The upper frame subassembly 28 includes two parallel frame members 52 and 54 spaced apart and two parallel frame members 56 and 58 (as seen in FIG. 1) spaced apart. These members 52–58 are fastened together to form a rectangle. The members 56 and 58 are connected to vertical members 38 and 40, respectively, with braces 60, fixed fasteners, and relatable fasteners 62. In this way, the upper frame subassembly 28 can rotate to change its angle $\alpha$ with a horizontal plane H. Plane H is parallel to the ground G. The members 52 and 54 have grooves 52*a* and 54*a* in the front and rear faces.

Additional braces, not discussed but shown, maybe used between the members of the frame so that the frame has the necessary structural rigidity. The frame may have a different configuration so long as it supports monitors 14 and 16 (as shown in FIG. 1) in the necessary orientation and provides the adjustability that the operator desires. Clamps can be connected to the bases 30 and 32 to retain the bases at a particular position. This frame can be formed of various materials, such as aluminum.

Figure 3:
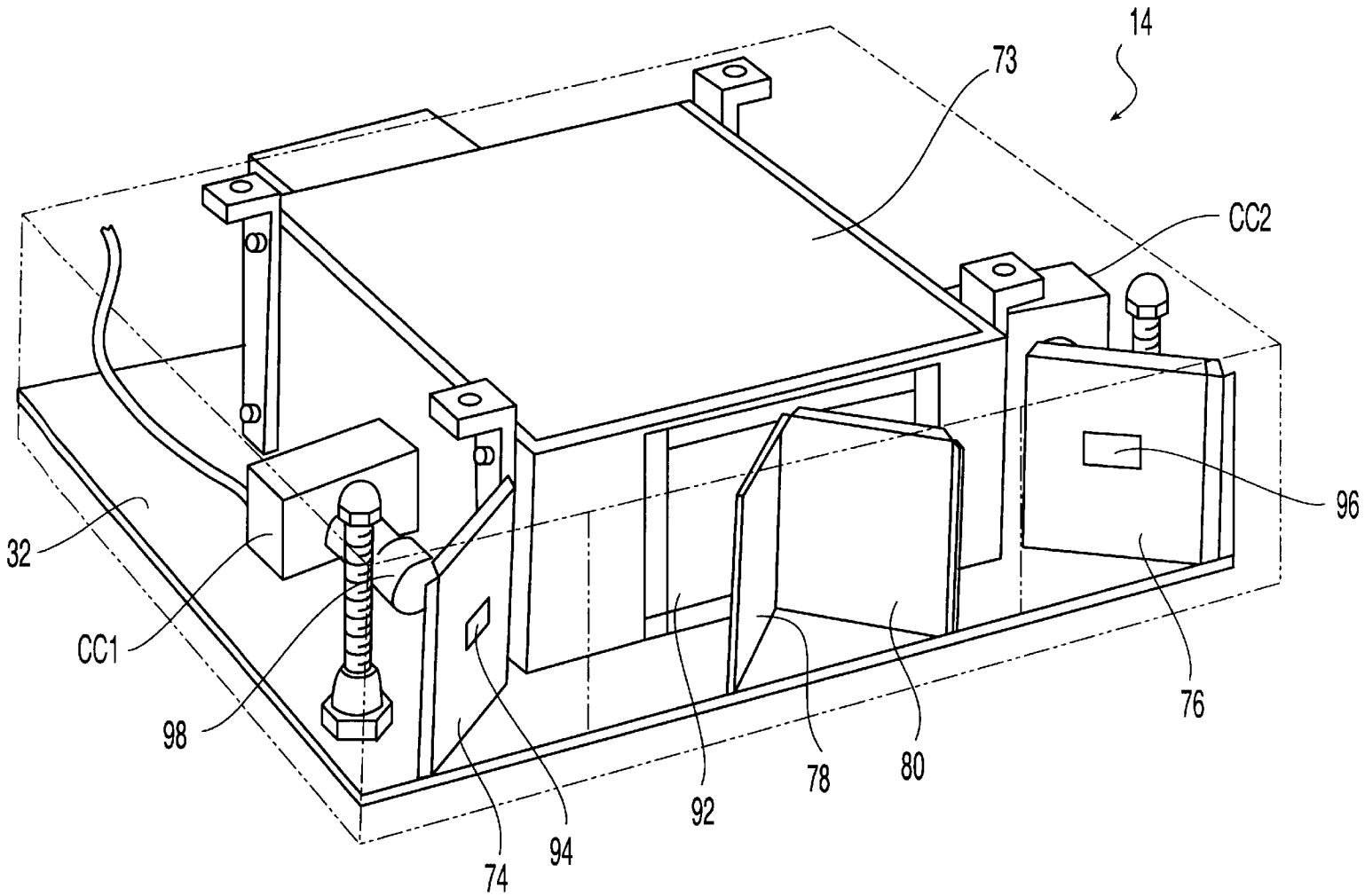
FIG. 3 is an enlarged, perspective view of the ball monitor of FIG. 1.

The rear end of the lower base 30 is connected to the member 48 of the frame via grooves 48*a* and a slide member 64 so that the base 30 is movable along the length of member 48. The front end of the lower base 30 has pads (not shown) as best seen in FIG. 3 for slidably cooperating with rod 34. The rod 34 is formed in separable segments so that it can be disassembled and assembled, alternatively a single-piece rod can be used.

The upper base 32 includes support members 68 onto which rotatable wheels 70 are mounted. The support members 68 and the wheels 70 are configured and dimensioned to cooperate with the grooves 52*a* and 54*a* so that the base 32 moves along the length of the members 52 and 54.

Figure 5A:
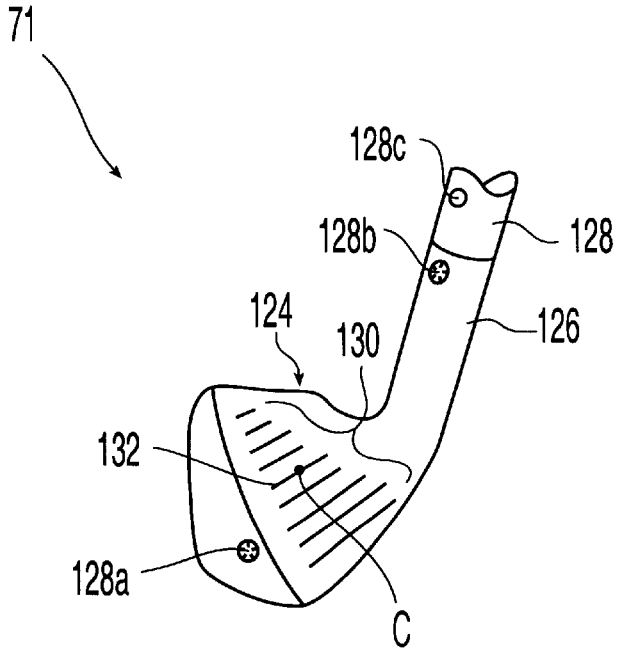
FIG. 5A is an enlarged, perspective view of a club head before a club calibration fixture is attached.
Figure 9:
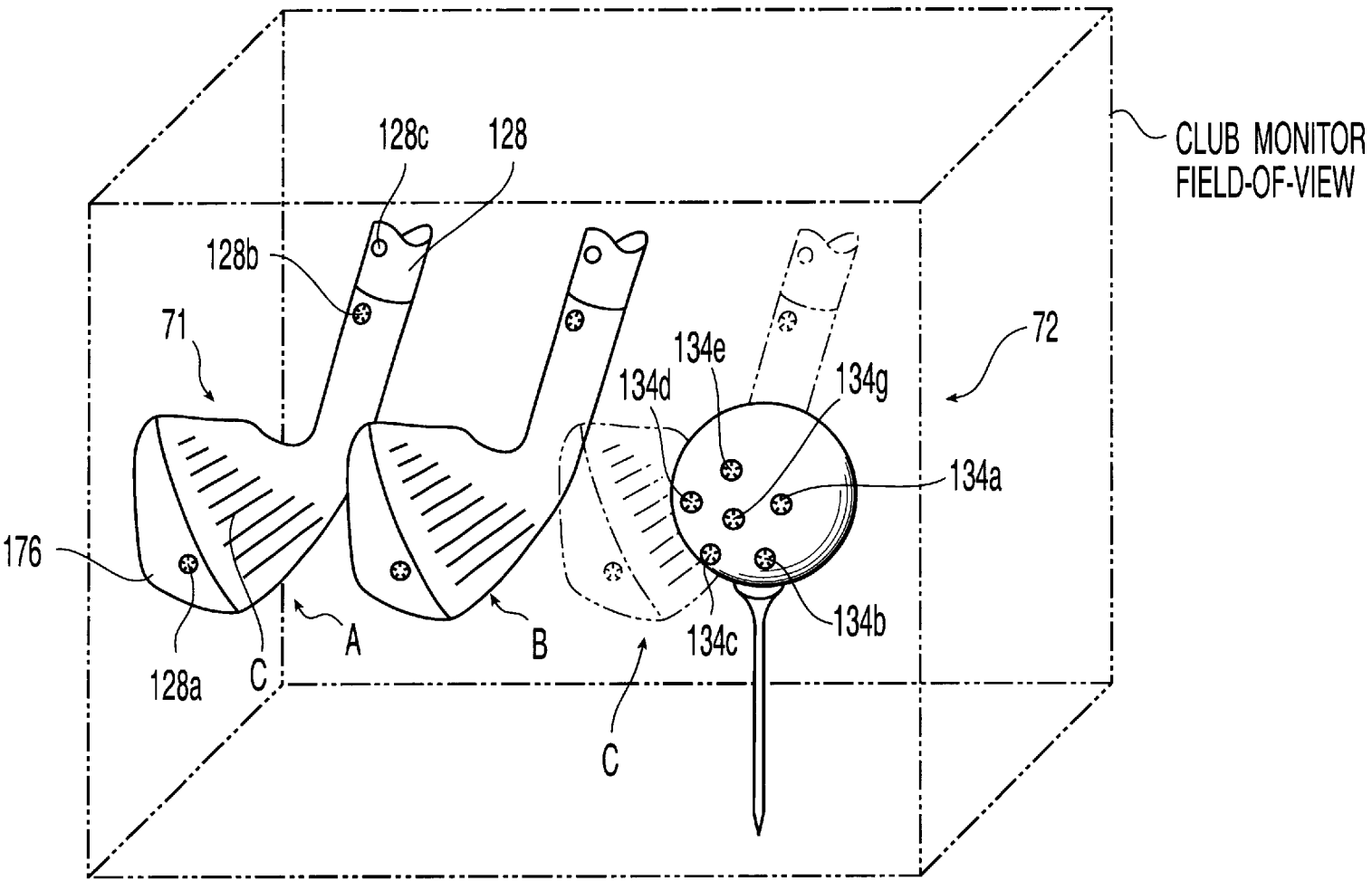
FIG. 9 is a perspective view of a three-dimensional field of view of the club monitor showing the golf club moving partially there through and showing a measured position A, a measured position B, and a projected impact position C.

Referring again to FIG. 1, the club monitor 14 is disposed aligned with a first horizontal plane H1 defined by the base 32, the ball monitor 16 is disposed aligned with a second horizontal plane H2 defined by the base 30 so that the club monitor 14 is vertically spaced there above by a distance $\Delta$H. The monitors 14 and 16 are further preferably positioned so that the center C1 of the club monitor 14 is spaced from the center C2 of the ball monitor 16 by a distance $\Delta$C. This arrangement allows the launch monitor system to capture images of a golf club 71 and a golf ball 72, as shown in FIGS. 5A and 9, as discussed in detail below.

Referring to FIG. 1, the club monitor 14 includes a first club camera CC1, a spaced second club camera CC2, a control box 73, four reflective elements 74, 76, 78, 80, a first club motion sensor 82 on a support 84, a second club motion sensor 86 on a support 88.

The cameras CC1 and CC2 used are electro-optical cameras with light-receiving apertures, shutters, and light sensitive silicon panels. CCD cameras are preferred but TV-type cameras are also useful. Recommended commercially available club cameras are manufactured by Sony under the name XC55⅓ inch diagonal CCD's.

Figure 4:
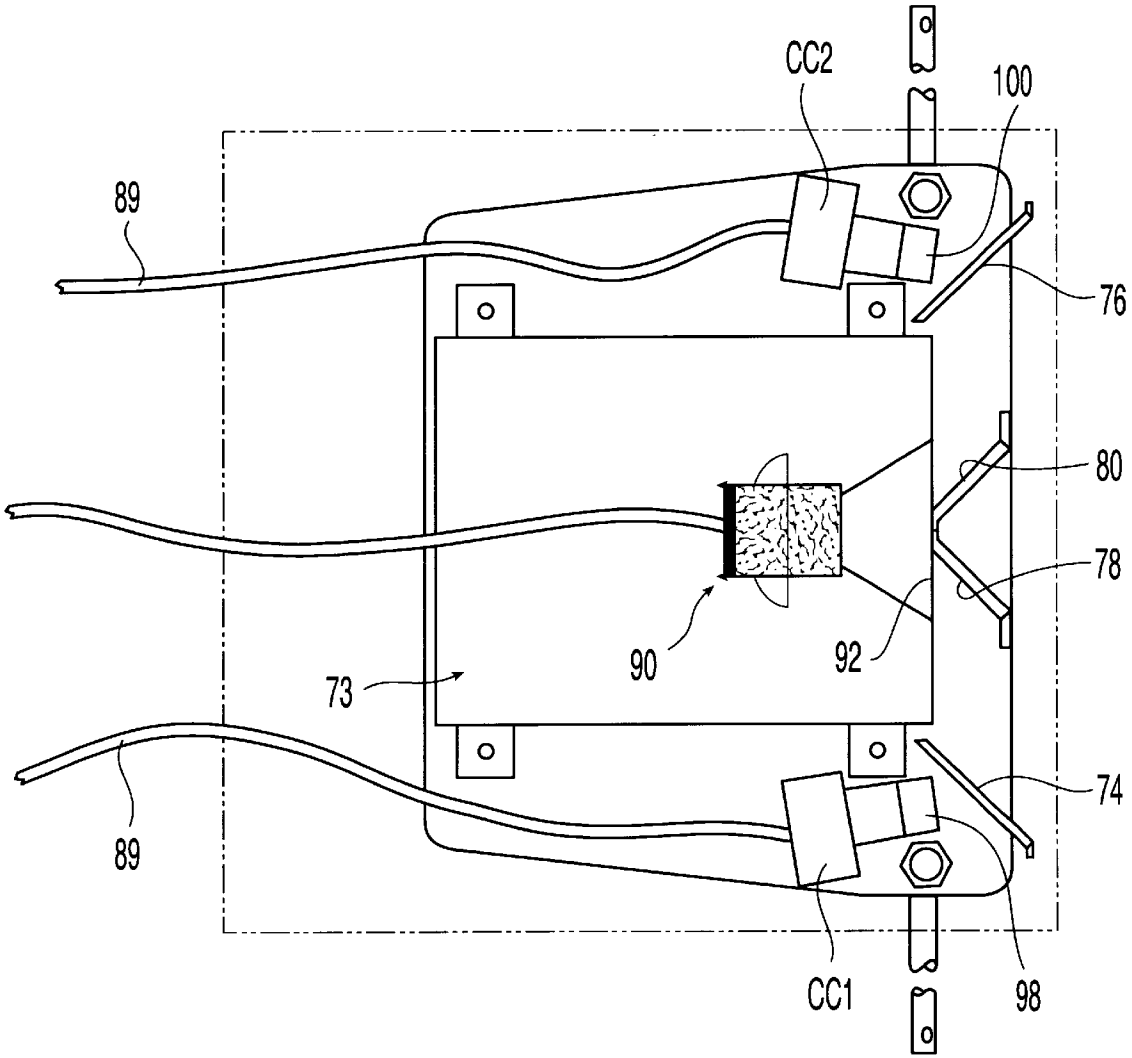
FIG. 4 is an enlarged, top view of the ball monitor of FIG. 3.

Referring to FIGS. 3 and 4, video lines 89 from the respective cameras CC1, CC2 lead to control box 73. The control box 73 includes a strobe light unit 90 and an optical or Fresnel lens 92 in front of the strobe light unit. The strobe light unit 90 is comprised of a single flash bulb assembly, the related circuitry, and a cylindrical flash tube. The strobe light unit single flash bulb assembly is capable of flashing faster than every 1000 microseconds. The circuits used with the strobe light unit are the subject of commonly assigned U.S. Pat. No. 6,011,359 to Days, which is incorporated herein in its entirety by express reference thereto.

The reflective elements or panels 74, 76, 78 and 80 are mounted to base 32. Reflective panels 74, 76 also include respective apertures 94, 96 and the cameras CC1 and CC2 and panels 74, 76 are mounted such that lenses 98, 100 (as shown in FIG. 4) are directed through the respective apertures 94, 96 in the reflective panels 74,76. Third and fourth reflective elements 78 and 80 are disposed in front of the Fresnel lense 92. Panel 78 reflects about one-half of the light from flash bulb unit 90 into panel 74, while panel 80 reflects the other half of the light into light-reflecting panel 76. Alternatively, ring-shaped strobe lights can be used which surround each camera lens, which would eliminate the need for reflective panels all together. The panels can also be eliminated if single or dual strobe lights adjacent each camera are used such as disclosed in U.S. Pat. No. 5,575,719 to Gobush et al. and incorporated herein in its entirety. Panels 74, 76, 78 and 80 may be plates formed of polished metal, such as aluminum, stainless steel, chrome-plated metal, or gold-plated metal.

Referring again to FIG. 1, club cameras CC1 and CC2 are electrically connected to the microprocessor 18 and computer 20 via cables 102. The first club motion sensor 82 and the second club motion sensor 86 shown are photoelectric sensors manufactured by Tritronics. The sensors 82 and 86 are for use with a reflective mount 104. The mount 104 includes a base 106 and two cylindrical rods 108 and 110. The cylindrical rods 108 and 110 have strips of reflective material on the side facing the cameras CC1 and CC2. A beam from the first club motion sensor 82 is reflected back to the sensor from the material on rod 108. A beam from the second club motion sensor 84 is reflected back to the sensor from the material on rod 110. Other types of sensors, such as a photodetector used with a receiving source, can also be used to actuate the monitor 14 cameras CC1 and CC2.

The ball monitor 16 similar to the club monitor 14 includes a first ball camera BC1, a spaced second ball camera BC2, a control box 112, four reflective elements 114, 116, 118, 120, a ball sensor 122.

The cameras BC1 and BC2 used are electro-optical cameras with light-receiving apertures, shutters, and light sensitive silicone panels as discussed in U.S. Pat. No. 5,575,719. CCD cameras are preferred but TV-type cameras are also useful. Recommended commercially available ball cameras are manufactured by Electrim Corporation under the name EDC cameras.

The control box 112 and four reflective elements 114, 116, 118, 120 are similar to those described with respect to the club monitor 14.

The ball motion sensor 122 is a microphone and is used to initiate the operation of the monitor 16. A laser or other apparatus (not shown) can also be used to initiate the system. For example, the initiating means can include a light beam and a sensor as with the club monitor 14.

The ball cameras BC1 and BC2 are directly electrically connected to the microprocessor 18 and indirectly connected to the computer 20. The microprocessor 18 tells the computer 20 to clear and ready the ball cameras. The sensor 122 is also electrically connected to the microprocessor 18 and the computer 20.

Referring to FIG. 5A, the club 71 includes a club head 124 with a hosel 126 and a shaft 128 is attached to the hosel 126. The club 71 further includes three (3) reflective spaced-apart round areas or markers 128*a–c* place thereon. The marker 128*a* is located on the toe of the club head 124. The marker 128*b* is located on the free end of the hosel 126. The marker 128*c* is located on the shaft 128. Although three markers are preferred, as few as two can be used. The present invention is not limited to the number of markers disclosed herein. The location of the markers can be changed in ways known to those of ordinary skill in the art. For example, on one club head two markers can be placed on the toe and one on the hosel, or on another club head one marker can be placed on the toe and two markers can be placed on the hosel.

The markers 128*a–c* have diameters of one-fourth (¼) to one-eighth (⅛) of an inch are preferred but other size and shaped areas can be used. Markers 128*a–c* are preferably made of reflective material which is adhered to the club head 124, hosel 126, and shaft 128. The "Scotchlite" brand beaded material made by Minnesota Mining and Manufacturing (3M) is preferred for forming the markers. Corner-reflective reflectors may also be used. Alternatively, painted markings, spots or a line can be used that defines at least one contrasting area.

The club head 124 further includes grooves 130 in the face. Groove 132 is disposed through the geometric center C of the club head and allows the geometric center C of the club head to be marked.

Figure 5B:
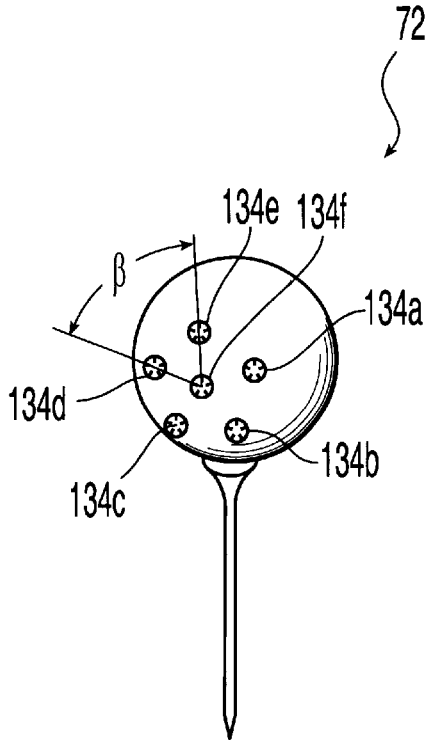
FIG. 5B is an enlarged, perspective view of a teed-up ball.

Referring to FIG. 5B, the teed ball 72 has similar markers 130*a–f*. The marker 130*f* is centrally located on the ball and the markers 130*a–e* are disposed thereabout. The angle between the non-central markers 130*a–e* is designated as β. It is recommended that the angle β is between about 10° and about 40°. Most preferably, the angle βis 30°. Rather than retro-reflective markers corner-reflective material or paint can also be used. Although six markers are shown, a single line or as few as two markers or as many as eleven markers can alternatively be used on the ball.

Figure 6:
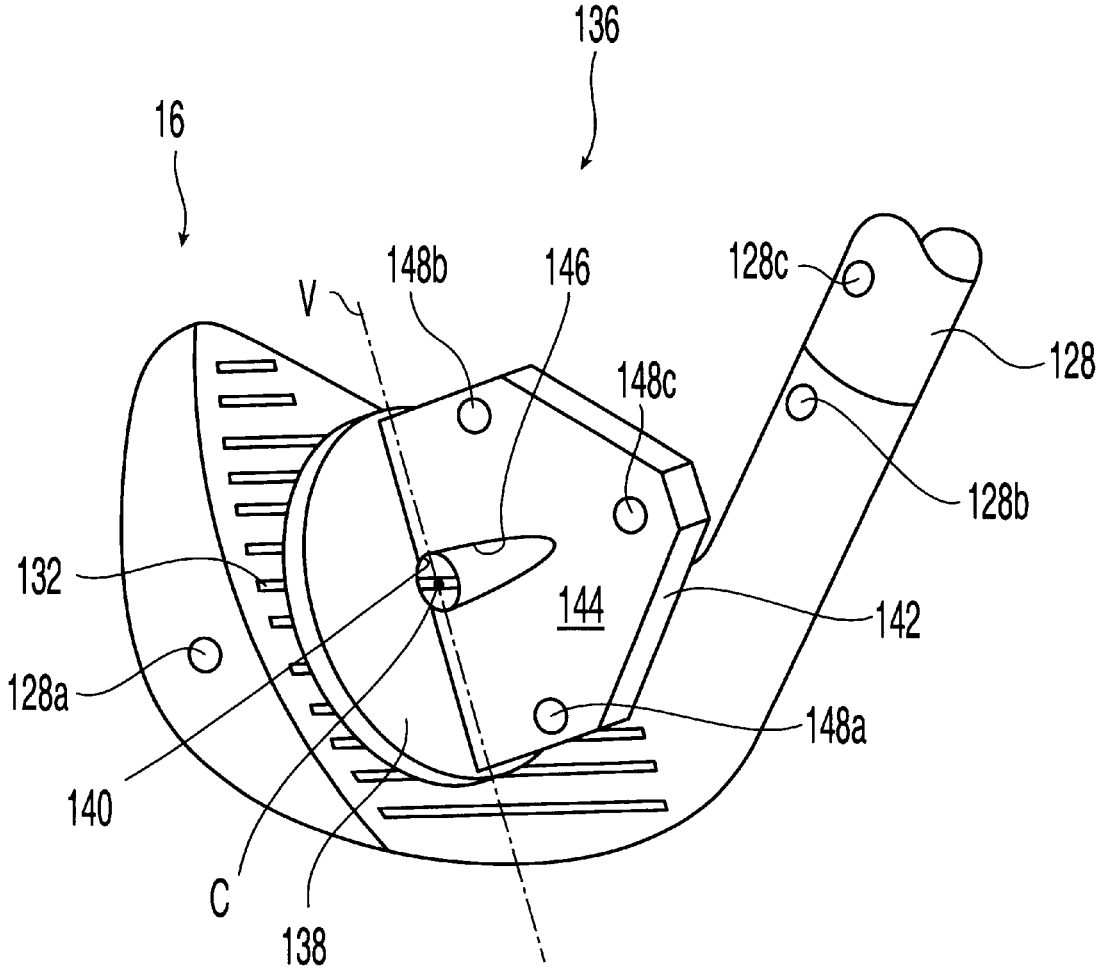
FIG. 6 is an enlarged, perspective view of the club head of FIG. 5A after the club calibration fixture is attached.

Referring to FIG. 6, in order to calibrate the club head 71 as discussed below, a club head calibration fixture 136 is used. The fixture 136 includes a magnetic base 138 which defines a centrally located bore 140 there through. Connected to the base 138 is an extension 142. The extension has a face 144 that is aligned with a vertical orientation line v, and a notch 146 that allows the bore 140 in the base 138 to be visible. The face 144 includes retro-reflective markers 148*a–c*. Markers 148*a–b* are aligned with one another and marker 148*c* is offset from these markers.

Figure 7:
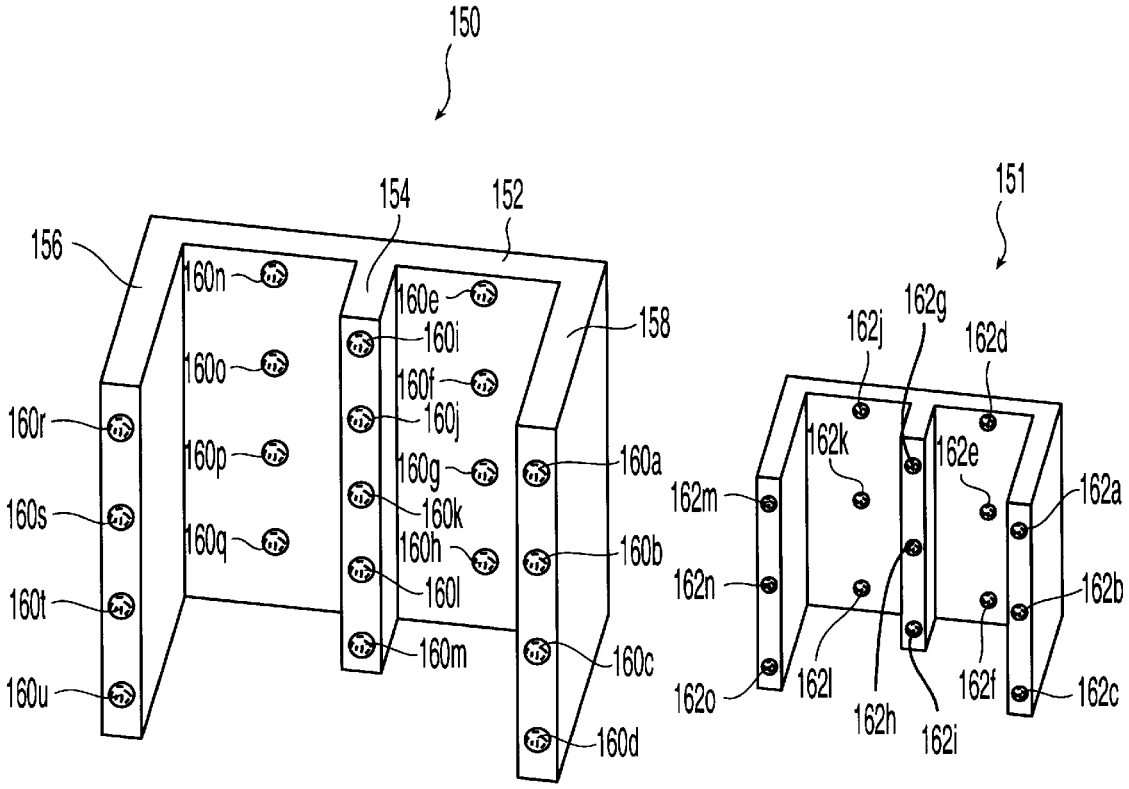
FIG. 7 is a front view of a club monitor fixture for use with the club monitor shown in FIG. 1 and a ball monitor fixture for use with the ball monitor shown in FIG. 1.

Referring to FIG. 7, in order to calibrate the monitors 14 and 16 (shown in FIG. 1) as discussed below, a club monitor fixture 150 and a ball monitor fixture 151 are used. The club monitor fixture 150 includes a back wall 152, a central wall or leg 154 extending from the back wall 152, outer wall or legs 156 and 158 extend from the back wall 152 spaced from the central leg 154. The length of the central leg 154 from the front surface of the back wall 152 is less than the length of the outer legs 156 and 158 from the front surface of the back wall 152.

The calibration fixture 150 in use should be positioned within the field-of-view of the cameras CC1 and CC2. Distance calibrators and tabs can be used with the fixture 150 to properly position it as disclosed in application Ser. No. 09/156,611 to Gobush et al. incorporated by reference in its entirety.

Calibration fixture 150 has a pattern of contrasting areas or retro-reflective markers 160*a–u*. Applicants have found that twenty-one markers are preferable. Fewer markers in the vertical direction on the calibration fixture are needed to adequately calibrate the system. The number of contrasting areas can be as low as six and more than twenty-one. Since the areas 160*a–u* are disposed on the back wall 152, free end of the central leg 154, and the free ends of the outer legs 156 and 158, the markers are located in three dimensions. However, the markers can also be located only within two dimensions. The markers can be replaced with contrasting painted areas in two- or three-dimensions.

Fixture 150 can further include an optical level indicator and legs or spikes for leveling the fixture.

Ball fixture 151 is configured similarly to club fixture 150 however, since the ball monitor 16 (as shown in FIG. 2) views a scene closer to the ground than the club monitor 14 the ball fixture 151 is shorter than the club fixture 151. Otherwise, the ball fixture 151 is configured similarly to the club fixture 150 and includes fifteen retro-reflective markers 162*a–o*. The number of contrasting areas can be as low as six and greater than fifteen. The modifications to the ball fixture can be similar to those suggested for the club fixture 151.

Figure 8:
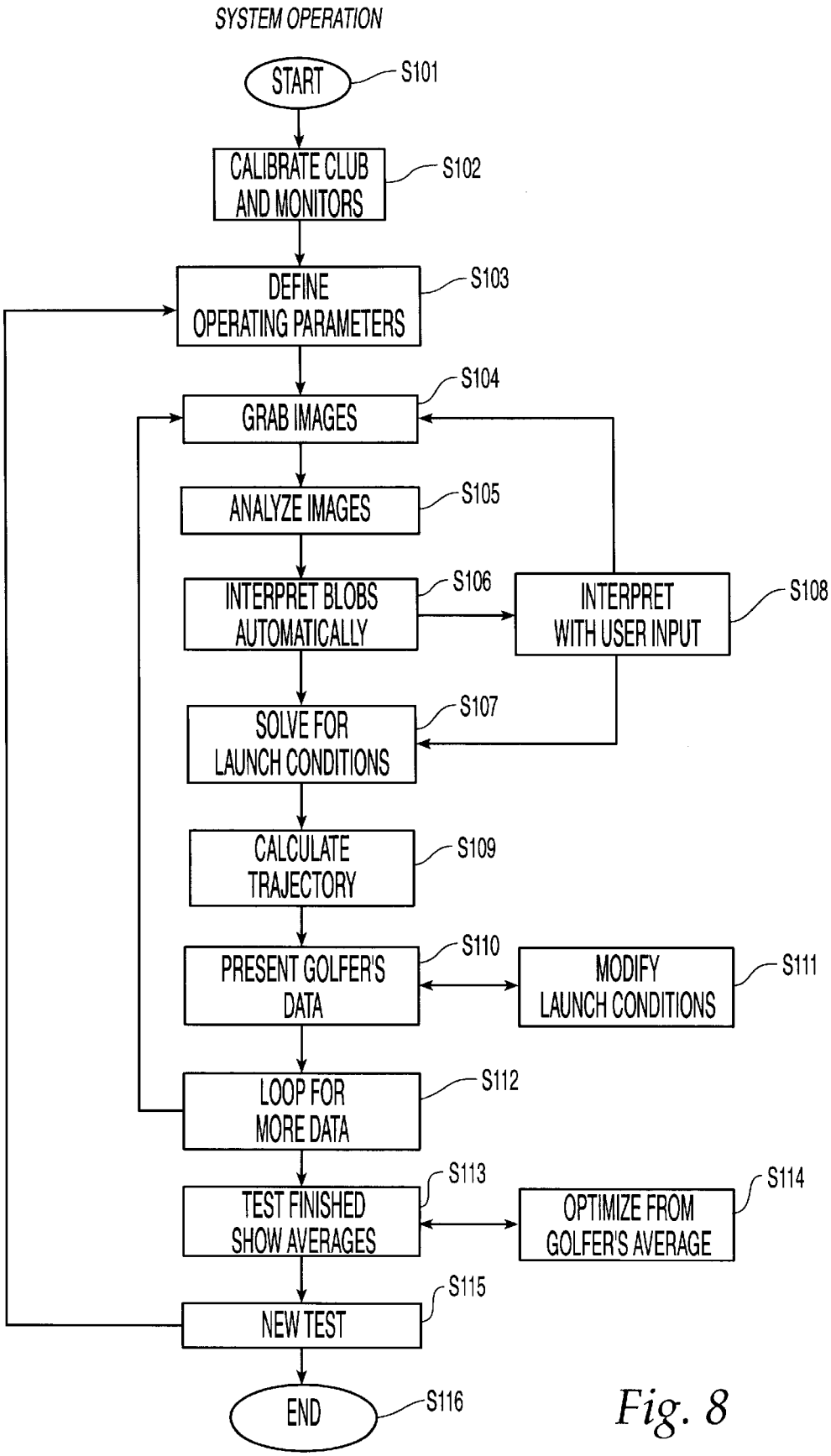
FIG. 8 is a flow chart describing the operation of the system.

The use of the system 10 (as shown in FIG. 1) is generally illustrated in FIG. 8. At step S101, the system starts and determines if this is the first time the system has been used. By default, the system will use the last calibration when it is first activated. Therefore, the system must be calibrated each time the system is moved and/or turned on.

At step S102, the operator calibrates the club head and the system. After calibration, the system is set at step S103 for either the left- or right-handed orientation, depending on the golfer to be tested. The selection of the left-handed orientation requires one set of coordinates are used for the left-handed golfer and right-handed system requires another set of coordinates for a right-handed golfer. At this time, the system is also set up as either a test or a demonstration. If the test mode is selected, the system will save the test data, while in the demonstration mode it will not save the data.

At step S103, additional data specific to the location of the test and the golfer is entered as well. Specifically, the operator enters data for ambient conditions such as temperature, humidity, wind speed and direction, elevation, and type of turf to be used in making the calculations for the golf ball flight, roll, and total distance. The operator also inputs the personal data of the golfer. This personal data includes name, age, handicap, gender, golf ball type (for use in trajectory calculations discussed below), and golf club used including information such as the type of club head (iron, driver, wood, loft, and lie) and information on the shaft.

After this data is entered, the system is ready for use and moves to step S104. At step S104, the system waits for the beam break between sensor 82 (as shown in FIG. 1) and rod 106 occurs when the club moves through the player's back swing. The sensor sends a signal to the microprecessor 18 to tell the computer to "arm" the ball cameras BC1 and BC2 so that they are ready to fire when signaled. Arming the ball cameras means the panel within the CCD camera is cleared and ready to be activated. The arming of the ball camera prior to taking images is due to the particular cameras BC1 and BC2 used. If other cameras are used that arm more quickly this step and the additional sensor 82 may not be necessary. The signal is also sent to the microprocessor 18 so that it is ready for the signal from the second swing sensor 86.

Figure 10:
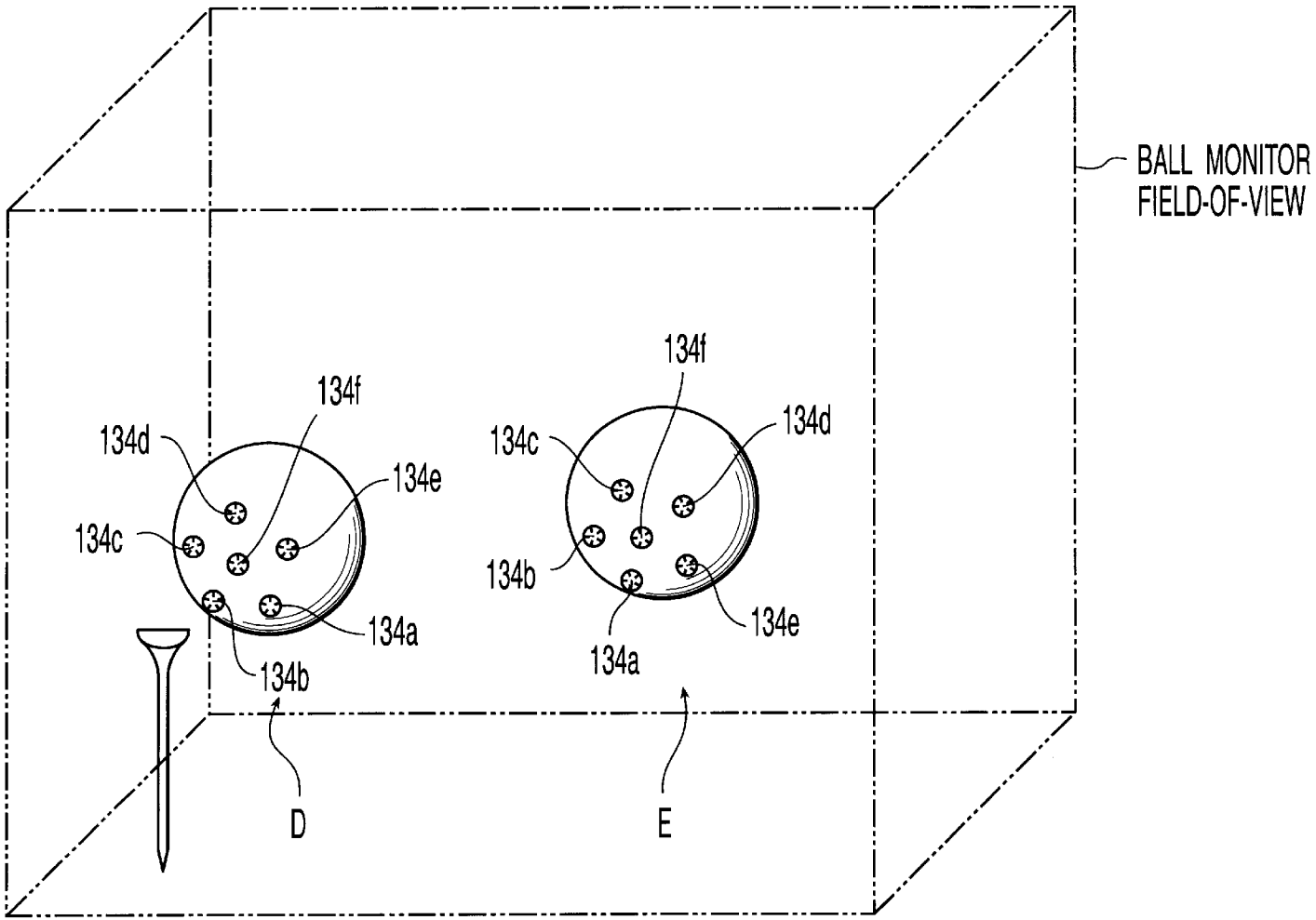
FIG. 10 is a perspective view of a three-dimensional field of view of the ball monitor showing a golf ball moving there through and showing a measured position D and a measured position E.

On the downswing, the beam between sensor 86 and rod 108 causes the club monitor 14 to expose the sensor panels to light. When the beam from 86 is broken, the club monitor 14 strobes twice during the same exposure of the sensor panels so that two images of the club head 71 at position A and B (as shown in FIG. 9) are in a single frame. When a sound of a sufficient level is picked up by the microphone 122, the ball monitor 16 (as shown in FIG. 1) obtains two images of the ball 72 (as shown in FIG. 10). The amount of time between the club images in FIG. 9 and the ball images in FIG. 10 is short, preferably 800 microseconds. The images are recorded by the silicon panel within each of the cameras, as discussed below and are used by the system to determine the club motion data and the ball motion data.

At steps S105–S107, the system uses several algorithms stored in the computer to determine the location of the golf ball relative to the monitor. After the computer has determined the location of the golf ball from the images, the system (and computer algorithms) determine the launch conditions. These determinations, which correspond to steps S105, S106, and S107, include locating the bright areas in the images, determining which of those bright areas correspond to the markers on the golf club or ball, and, then using this information to determine the location of the club or ball from the images, and calculate the data, as discussed below, respectively. Specifically, the system at step S105 analyzes the images recorded by the cameras by locating the bright areas in the images. A bright area in the image corresponds to light from the flash bulb assembly reflecting off of the retro-reflective markers or markers on the golf club or ball.

Figure 11:
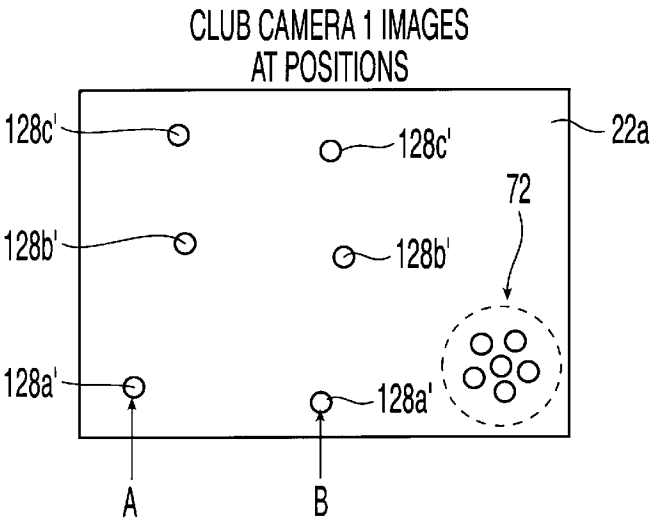
FIG. 11 is a front view of a monitor screen showing the image obtained by a first club camera of the club monitor.
Figure 12:
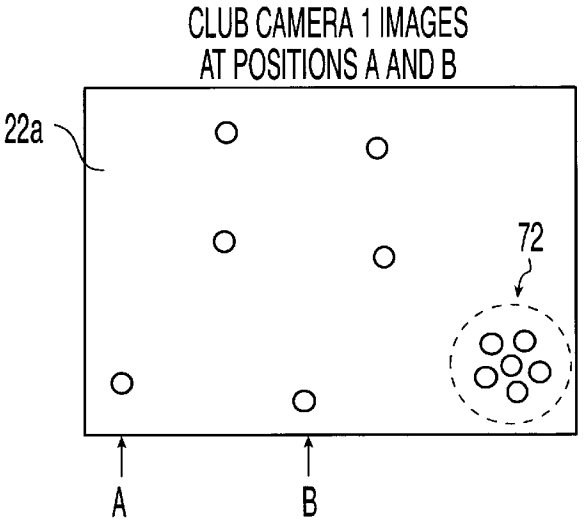
FIG. 12 is a front view of the monitor screen showing the image obtained by a second club camera of the club monitor.

Since the golf club preferably has three markers on it, the system should find six bright areas that represent the club markers in the images from each of the two cameras. FIG. 11 represents the images received by camera CC1 and FIG. 12 represents the images received by camera CC2 of the club head prior to ball impact as shown on monitor screen 22*a*. The system then determines which of those bright areas correspond to the golf club's reflective markers at step S106.

Figure 13:
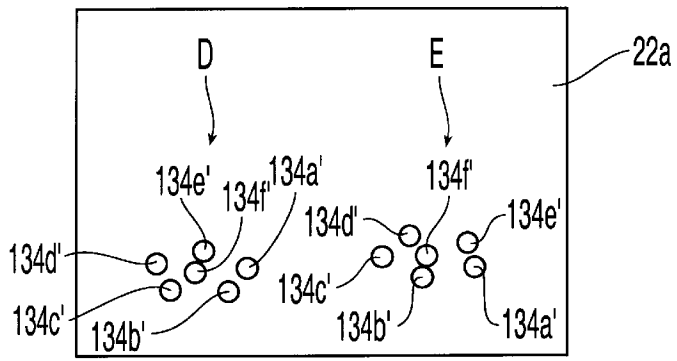
FIG. 13 is a front view of the monitor screen showing the image obtained by a first ball camera of the ball monitor.

Since the ball preferably has 6 markers on it, the system should find twelve bright areas that represent the markers in the images from each of the cameras BC1 and BC2 (2 images of the golf ball with 6 markers). FIG. 13 represents the images received by camera BC1 and FIG. 13 represents the images received by camera BC2 of the ball after impact as shown on monitor screen 22*a*. The system then determines which of those bright areas correspond to the golf ball's reflective markers at step S106. As discussed in detail below, this can be done in several ways. If with the club only six markers are found in the image or with ball only twelve markers are found in the image, the system moves on to step S107 to determine, from the markers in the images, the position and orientation of the golf ball during the first and second images.

However, if there are more or less than the desired number of markers or bright areas found in the images, then at step S108 the system allows the operator to manually change the images. If too few bright areas are located, the operator adjusts the image brightness, and if too many are present, the operator may delete any additional bright areas. In some instances, the bright areas in the images may be reflections off of other parts of the golf ball or off the golf club head. If it is not possible to adequately adjust the brightness or eliminate those extraneous bright areas, then the system returns the operator to step S104 to have the golfer hit another golf ball. If the manual editing of the areas is successful, however, then the system goes to step S107.

At step S107, the system uses the identification of the markers in step S106 to determine the location of the centers of each of the six or twelve markers in each of the two images. Knowing the location of the center of each of the markers, the system can calculate the golf club's speed, loft angle, attack angle, path angle, face angle, droop angle, loft spin, face spin, droop spin, and hit location. In addition, the system can calculate the ball's velocity, launch angle, backspin, side angle, side spin rifling spin, carry distance, direction, carry and roll distance.

At step S109, the system uses this information, as well as the ambient conditions and the golf ball information entered at step S103 to calculate the trajectory of the golf ball during the shot. The system will also estimate where the golf ball will land (carry), and even how far it will roll, giving a total distance for the shot. Because the system is calibrated in three dimensions, the system will also be able to calculate if the golf ball has been sliced or hooked, and how far off line the ball will be.

This information (i.e., the golfer's club and ball data) is then presented to the golfer at step S110, in numerical and/or graphical formats. At step S111, the system can also calculate the same information if a different golf ball had been used (e.g., a two-piece rather than a three-piece golf ball). It is also possible to determine what effect a variation in any of the launch conditions (golf ball speed, spin rate, and launch angle) would have on the results.

The golfer also has the option after step S112 to take more shots by returning the system to step S104. If the player had chosen the test mode at step S103 and several different shots were taken, at step S113 the system calculates and presents the average of all data accumulated during the test. At step S114, the system presents the golfer with the ideal launch conditions for the player's specific capabilities, thereby allowing the player to make changes and maximize distance. The system allows the golfer to start a new test with a new golf club, for example, at step S115, or to end the session at S116.

Figure 15:
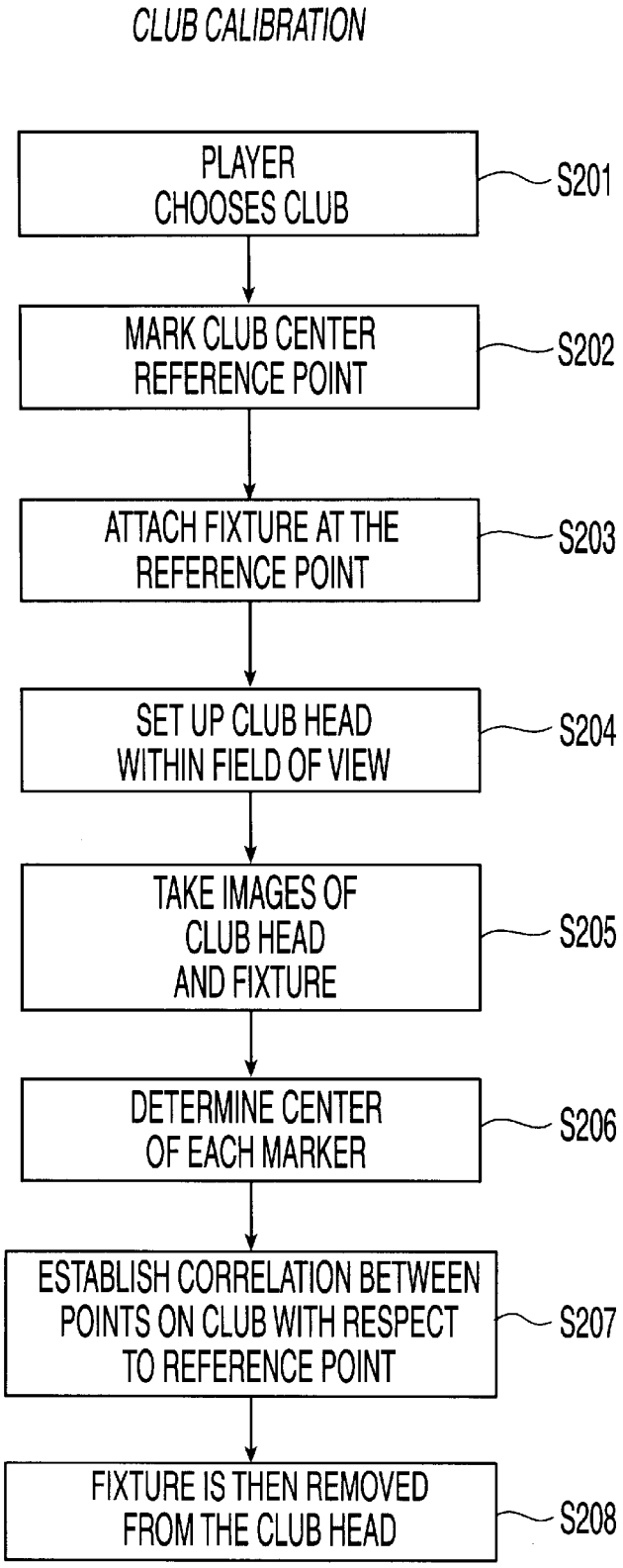
FIG. 15 is a flow chart describing the calibration of the club head.

Now turning to the calibration step S102 (as shown in FIG. 8) which is represented in detail in FIG. 15, the calibration begins with calibrating the club head. Referring to FIGS. 5A and 6, as in step 201 the player selects a club head 71. Then in step 202, an operator using the center groove 132 locates and marks the geometric center C or sweet spot of the club head with a marking. With reference to FIGS. 6 and 15, in step S203 the operator attaches the calibration fixture 136 to the club head face so that the geometric center C is centered in the bore 140 in the base 138. As stated in steps S204 and S205, the club head 71 is then set up in the field-of-view of the club monitor 14 and held stationary until a single image is obtained of the club head and fixture by the cameras CC1 and CC2. The image will include contrasting areas due to reflection of the light from the monitor 14 off of markers 148*a–c*. The microprocessor 18 controls the timing of the cameras flashes. The transformation algorithm(s) in the computer 20 in step S206 correlate points on the club head with respect to the reference point or geometric center of the club head. The details of the fixture 136 are disclosed in U.S. Pat. No. 5,575,719 to Gobush et al., incorporated by reference in its entirety.

Figure 16:
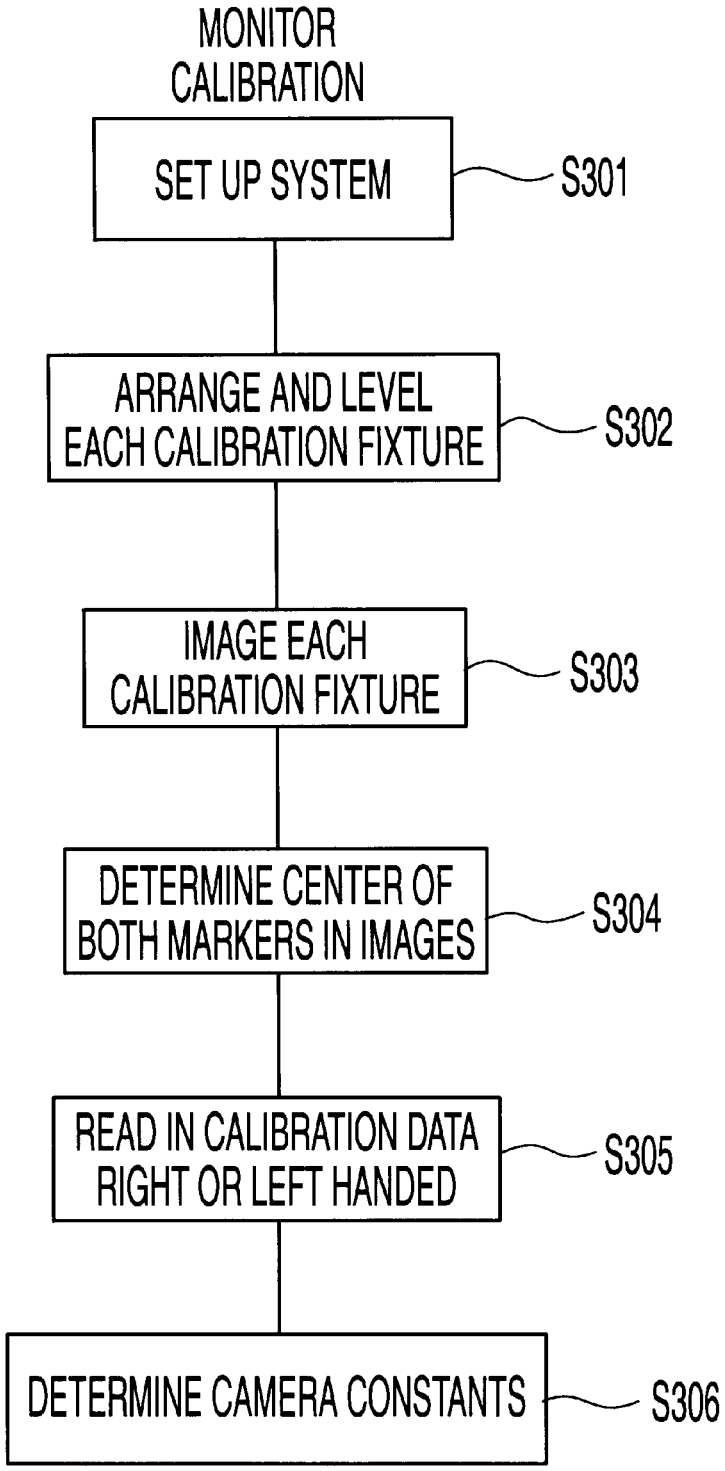
FIG. 16 is a flow chart describing the calibration of the club and ball monitors.

With reference to FIGS. 1 and 8, calibration step S102 after using the fixture 136 further includes calibrating the monitors 14 and 16. The details of this step are illustrated in FIG. 16. First, in step S301 the system 10 is set up and leveled. The system 10 is preferably set up on level ground, such as a practice tee or on a level, large field. Obviously, it is also possible to perform the tests indoors, hitting into a net. The system is positioned to set the best view of the events and the predetermined fields-of-view. Then at step S302, the calibration fixtures 150 and 151 (as shown in FIG. 7) are placed in the appropriate locations within fields-of-view of monitor 14 and monitor 16, respectively. This is about 40 inches from the fixture 150 to the CC1 and CC2 cameras and about 30 inches from the fixture 151 to the BC1 and BC2 cameras. Preferably, the calibration fixtures 150 and 151 are level and parallel to the system to ensure the best reflection of the light from the flash bulb assemblies in the monitors. Both cameras CC1 and CC2 and BC1 and BC2 of each monitor 14 and 16, respectively, obtains a picture of each calibration fixture and send the image to a buffer in step S303.

In step S304, the system includes a calibration algorithm used to determine the location of the centers of the spots in each image corresponding to each calibration fixtures' retro-reflective markers 160*a–u* and 162*a–o*.

The system must know the true spacing of the markers on the calibration fixture 150. To make this determination for the club fixture 150 and monitor 14, eleven constants determine the focal length, orientation and position of each camera CC1 and CC2 given the premeasured points on fixture 150 and the twenty-one U and V coordinates digitized on each camera's sensor panels.

Sensor panels of each camera CC1 and CC2 which receive successive light patterns that contain 480 lines of data and 640 pixels per line. A computer algorithm is used for centroid detection of each marker 160*a–u*. Centroid detection of a marker is the location of the center area of the marker for greater accuracy and resolution. Each image received from markers 160*a–u* results in an apparent x and y center position of each marker. Where light is low in the field of vision due to gating, an image intensifier may be used in conjunction with the sensor panels. An image intensifier is a device which produces an output image brighter than the input image.

The X, Y and Z coordinates of the center of each marker 160*a–u* which are arranged in a three-dimensional pattern were premeasured to accuracy of one of one-ten thousandth of an inch on a digitizing table and stored in the computer. An image of the calibration fixture 150 is obtained by the two cameras CC1 and CC2.

This image determines the eleven (11) constants relating image space coordinates U and V to the known twenty-one X, Y and Z positions on the calibration fixture 150. The equations relating the calibrated X(i), Y(i), Z(i) spaced points with the $U_i^{(j)}$, $V_i^{(j)}$ image points are:

$$U_i^j = \frac{D_{1j}X(i) + D_{2j}Y(i) + D_{3j}Z(i) + D_{4j}}{D_{9j}X(i) + D_{10j}Y(i) + D_{11j}Z(i) + 1} \quad \text{(Eq. 1)}$$

where i=1,21; j=1,2.

$$V_i^j = \frac{D_{5j}X(i) + D_{6j}Y(i) + D_{7j}Z(i) + D_{8j}}{D_{9j}X(i) + D_{10j}Y(i) + D_{11j}Z(i) + 1} \quad \text{(Eq. 2)}$$

The eleven constants, Di1 (i=1,11) for camera CC1 and the eleven constants, Di2 (i=1,11) for camera CC2 are solved from knowing X(i), Y(i), Z(i) at the 21 locations and the 21 Ui(j), Vi(j) coordinates measured in the calibration photo for the two cameras.

An exemplary set of these three-dimensional positions for right-hand calibration for the calibration fixture with 21 markers appear below:

| | | | | | | | | | | | |
|---|---|---|---|---|---|---|---|---|---|---|---|
| (1) | −3.0 | 5.0 | 0.0 | (2) | −3.0 | 4.0 | 0.0 | (3) | −3.0 | 3.0 | 0.0 |
| (4) | −3.0 | 2.0 | 0.0 | (5) | 3.0 | 4.0 | 1.5 | (6) | 3.0 | 3.0 | 1.5 |
| (7) | 3.0 | 2.0 | 1.5 | (8) | 3.0 | 1.0 | 1.5 | (9) | 0.0 | 5.0 | 3.0 |
| (10) | 0.0 | 4.0 | 3.0 | (11) | 0.0 | 3.0 | 3.0 | (12) | 0.0 | 2.0 | 3.0 |
| (13) | 0.0 | 1.0 | 3.0 | (14) | 3.0 | 4.0 | 4.5 | (15) | 3.0 | 3.0 | 4.5 |
| (16) | 3.0 | 2.0 | 4.5 | (17) | 3.0 | 1.0 | 4.5 | (18) | −3.0 | 5.0 | 6.0 |
| (19) | −3.0 | 4.0 | 6.0 | (20) | −3.0 | 3.0 | 6.0 | (21) | −3.0 | 2.0 | 6.0 |

An exemplary set of these three-dimensional positions for left-hand calibration for the calibration fixture with 21 markers appear below:

| | | | | | | | | | | | |
|---|---|---|---|---|---|---|---|---|---|---|---|
| (1) | 3.0 | 5.0 | 6.0 | (2) | 3.0 | 4.0 | 6.0 | (3) | 3.0 | 3.0 | 6.0 |
| (4) | 3.0 | 2.0 | 6.0 | (5) | −3.0 | 4.0 | 4.5 | (6) | −3.0 | 3.0 | 4.5 |
| (7) | −3.0 | 2.0 | 4.5 | (8) | −3.0 | 1.0 | 4.5 | (9) | 0.0 | 5.0 | 3.0 |
| (10) | 0.0 | 4.0 | 3.0 | (11) | 0.0 | 3.0 | 3.0 | (12) | 0.0 | 2.0 | 3.0 |
| (13) | 0.0 | 1.0 | 3.0 | (14) | −3.0 | 4.0 | 1.5 | (15) | −3.0 | 3.0 | 1.5 |
| (16) | −3.0 | 2.0 | 1.5 | (17) | −3.0 | 1.0 | 1.5 | (18) | 3.0 | 5.0 | 0.0 |
| (19) | 3.0 | 4.0 | 0.0 | (20) | 3.0 | 3.0 | 0.0 | (21) | 3.0 | 2.0 | 0.0 |

The system locates the centers of the spots from the ball fixture 151 by identifying the positions of the pixels in the buffer that have a light intensity greater than a predetermined threshold value. Since the images are two-dimensional, the positions of the pixels have two components (x,y). The system searches the images for bright areas and finds the edges of each of the bright areas. The system then provides a rough estimate of the centers of each of the bright areas. Then all of the bright pixels in each of the bright areas are averaged and an accurate marker position and size are calculated for all 15 areas from the ball fixture. Those with areas smaller than a minimum area are ignored. Once the location of each of the markers on the calibration fixture 151 with respect to cameras BC1 and BC2 are determined, the system must know the true spacing of the markers on the calibration fixture 151. To make this determination for the ball fixture 151 and monitor 16, the calibration fixture has markers arranged in three rows and five columns. The markers are placed about one inch apart, and on three separate X planes that are 1.5 inches apart. The X, Y, and Z coordinates of the center of each marker 170*a–o*, which are arranged in a three-dimensional pattern, were pre-measured to accuracy of one of one-ten thousandth of an inch on a digitizing table and stored in the computer. The system recalls the previously stored data of the three-dimensional positions of the markers on the calibration fixture relative to one another. The recalled data depends on the whether a right-handed (X-axis points toward the golfer) or a left-handed (X-axis points away from the golfer) system is used. Both sets of data are stored and can be selected by the operator at step S305. An exemplary set of these three-dimensional positions for right-hand calibration for the calibration fixture with 15 markers appear below:

| | | |
|---|---|---|
| (1) −1.5 3.0 0.0 | (2) 1.5 3.0 1.0 | (3) 0.0 3.0 2.0 |
| (4) 1.5 3.0 3.0 | (5) −1.5 3.0 4.0 | (6) −1.5 2.0 0.0 |
| (7) 1.5 2.0 1.0 | (8) 0.0 2.0 2.0 | (9) 1.5 2.0 3.0 |
| (10) −1.5 2.0 4.0 | (11) −1.5 1.0 0.0 | (12) 1.5 1.0 1.0 |
| (13) 0.0 1.0 2.0 | (14) 1.5 1.0 3.0 | (15) −1.5 1.0 4.0 |

An exemplary set of these three-dimensional positions for left-hand calibration for the calibration fixture with 15 markers appear below:

| | | |
|---|---|---|
| (1) 1.5 3.0 4.0 | (2) −1.5 3.0 3.0 | (3) 0.0 3.0 2.0 |
| (4) −1.5 3.0 1.0 | (5) 1.5 3.0 0.0 | (6) 1.5 2.0 4.0 |
| (7) −1.5 2.0 3.0 | (8) 0.0 2.0 2.0 | (9) −1.5 2.0 1.0 |
| (10) 1.5 2.0 0.0 | (11) 1.5 1.0 4.0 | (12) −1.5 1.0 3.0 |
| (13) 0.0 1.0 2.0 | (14) −1.5 1.0 1.0 | (15) 1.5 1.0 0.0 |

At step S306, using the images of the calibration fixture 151, the system determines eleven (11) constants relating image space coordinates U and V to the known fifteen X, Y, and Z positions on the calibration fixture. The equations relating the calibrated X(I), Y(I), Z(I) spaced points with the $U_i^j$, $V_i^j$ image points are:

$$U_i^j = \frac{D_{1j}X(i) + D_{2j}Y(i) + D_{3j}Z(i) + D_{4j}}{D_{9j}X(i) + D_{10j}Y(i) + D_{11j}Z(i) + 1} \quad \text{(Eq. 3)}$$

where i=1,15; j=1,2.

$$V_i^j = \frac{D_{5j}X(i) + D_{6j}Y(i) + D_{7j}Z(i) + D_{8j}}{D_{9j}X(i) + D_{10j}Y(i) + D_{11j}Z(i) + 1} \quad \text{(Eq. 4)}$$

The eleven constants, $D_{i1}$(I=1,11), for camera 136 and the eleven constants, $D_{i2}$ (I=1,11), for camera 138 are solved from knowing X(I), Y(I), Z(I) at the 15 locations and the 15 $U_i^j$, $V_i^j$ coordinates measured in the calibration photo for the two cameras.

In another embodiment, during image analysis the system uses the standard Run Length Encoding (RLE) technique to locate the bright areas. The RLE technique is conventional and known by those of ordinary skill in the art. Image analysis can occur during calibration or during an actual shot. Once the bright areas are located using the RLE technique, the system then calculates an aspect ratio of all bright areas in the image to determine which of the areas are the retro-reflective markers. The technique for determining which bright areas are the markers is discussed in detail in below with respect to FIG. 17.

As noted above, once the system is calibrated in step S102, the operator can enter the ambient conditions, including temperature, humidity, wind, elevation, and turf conditions. Next, the operator inputs data about the golfer. For example, the operator enters information about the golfer, including the golfer's name, the test location, gender, age and the golfer's handicap. The operator also identifies the golf ball type and club type, including shaft information, for each test. The operator can also input various hardware set up parameters such as mode of operation (i.e., club and ball data acquisition, club only data acquisition or ball only data acquisition), microphone sensitivity, ball cameras' sensor adjustment, delay times between strobed images of the club and ball in for example microseconds. The particular make of the ball cameras allows software adjustment of the camera sensors the club cameras selected do not have this feature. Another club camera may have this feature. The operator can also input various test setup parameters such as where the data should be stored and a description for the data. In addition, the operator can input system calibration variables such as the accuracy of the club and ball cameras along each axis.

With the calibration complete and reference to FIGS. 1 and 9, a golf ball 72 is then set on a tee where the calibration fixture was located (about 40 inches from cameras CC1 and CC2), club 71 is placed behind ball 72 at address and club head 126 on a shaft 128 is swung through three-dimensional club monitor 14 field-of-view. About six inches before the striking of the ball, a light beam between sensor 86 to rod 110 is broken and transmits a signal to open the shutter of camera CC1 and camera CC2 and to expose the image sensor panel in cameras CC1 and CC2 to light from the three (3) club 71 markers 128*a–c* and six (6) stationary ball markers 134*a–f*. This illumination occurs when the club 71 is a position A. A predetermined time later, such as eight (8) hundred microseconds later, the flash light unit 90 (as shown in FIG. 4) fires a flash of light which again illuminates the club 71 markers 128*a–c* and six (6) stationary ball markers 134*a–f*. This occurs when the club 71 is a position B. Although the system can be used with only two flashes of light, more preferably if acceleration data is desired the strobe pulses in succession at least three times so that three images of the club are obtained. As a result, acceleration data can be obtained from two velocity measurements.

Flashes of light are between one-ten thousandth and a few millionths of a second in duration. Very small apertures are used in cameras CC1 and CC2 to reduce ambient light and enhance strobe light. As light reflects off markers 128*a–c* in their two positions, it reaches sensor panels forming corresponding panel areas that are digitized and viewable on the computer monitor 22 screen 22*a*. The images from the markers 128*a–c* on the screen are shown as markers 128*a'-c'*in FIGS. 11 and 12.

Using the known time between camera operation and the known geometric relationships between the cameras, the external computing circuits are able to calculate the X, Y and Z positions of each enhanced marker in a common coordinate system at the time of each snapshot. From the position information and the known data, the external computing circuits are able to calculate the club head velocity and spin (or rotation) in three dimensions during the immediate pre-impact ball 72 launch time period which pre impact condition is determined by calculation based on data from club head positions A and B data and the known position of stationery ball 72 from position B. In addition, the path direction, attack angle, and hit location are calculable from the position B information provided by the three reflective markers 128*a–c* on club 71.

As a golfer swings club 71 through the club monitor field-of-view, the system electronic images are seen through the cameras CC1 and CC2 as shown on in FIGS. 11 and 12. The right hand field-of-view of camera CC1 (in FIG. 11) will differ slightly from the left hand field-of-view of camera CC2 due to the 20° angle difference in camera orientation. The resulting equations to be solved given the camera coordinates, $U_i^{(j)}$, $V_i^{(j)}$ for the three club markers, i, and two cameras j are as follows:

$$U_i^j = \frac{D_{1j}X(i) + D_{2j}Y(i) + D_{3j}Z(i) + D_{4j}}{D_{9j}X(i) + D_{10j}Y(i) + D_{11j}Z(i) + 1} \quad \text{(Eq. 5)}$$

where i=1,3; j=1,2.

$$V_i^j = \frac{D_{5j}X(i) + D_{6j}Y(i) + D_{7j}Z(i) + D_{8j}}{D_{9j}X(i) + D_{10j}Y(i) + D_{11j}Z(i) + 1} \quad \text{(Eq. 6)}$$

With the known coordinates X(i), Y(i), Z(i) i=1, 3 for the club 71 in position A, computer 20 further analyzes the positions of X(i), Y(i), Z(i), i=1, 3 at the second position B in FIG. 9. In addition, the electronic image contains the location of six markers 134*a–f* on golf ball 72. The triangulation from the data of cameras CC1, CC2 allows us to locate the position of six markers 134*a–f* on the surface of the ball. With information as to the six markers 134*a–f* on the surface and radius of ball 72, the center of ball 72, Xc, Yc, Zc are calculated by solving the six (6) equations:

$$(X_1^B - H_C)^2 + (Y_i^B - Y_C)^2 + (Z_1^B - Z_C)^2 + (\text{RADIUS})^2 I = 1 \ldots 6. \quad \text{(Eq. 7)}$$

With the positional information of markers 128*a–c* on the club 71 known, the location of the center of the club face $C(C_x, C_y, C_z)$ and its local coordinate system are found at the two strobed position A and B prior to impact with the ball 72 through the club calibration procedure previously described. The velocity components of the center of club 71 along the three axis of the coordinate system are then computed from the formulas:

$$V_x = \frac{T_x(t + \Delta T) - T_x(t)}{\Delta T} \quad \text{(Eq. 8)}$$

$$V_y = \frac{T_y(t + \Delta T) - T_y(t)}{\Delta T} \quad \text{(Eq. 9)}$$

$$V_z = \frac{T_z(t + \Delta T) - T_z(t)}{\Delta T} \quad \text{(Eq. 10)}$$

in which ΔT is the time interval between strobe firings.

The club head spin components result from the matrix of direction cosines relating the orientations of markers 128*a–c* on the club head 126 in one orientation to those in the second orientation. If we denote this matrix by A with elements Aij (i=1,3; j=1,3) then the magnitude, θ, of the angle of rotation vector of the two club head orientations during the time increment ΔT is given by:

$$\theta = \sin^{-1}\left(\frac{R}{2}\right) \quad \text{(Eq. 11)}$$

$l = A_{32} - A_{23}$;

$m = A_{13} - A_{31}$; and $n = A_{21} - A_{12}$.

The three orthogonal components of spin rate, $W_x$, $W_y W_z$, are given by:

$$W_x = \sin^{-1}(R/2)L/(R\Delta T) = \theta L/(R\Delta T) \quad \text{(Eq.12)}$$

$$W_y = \sin^{-1}(R/2)M/(R\Delta T) = \theta M/(R\Delta T) \quad \text{(Eq.13)}$$

$$W_z = \sin^{-1}(R/2)N/(R\Delta T) = \theta N/(R\Delta T) \quad \text{(Eq.14)}$$

From calculating the distance between the center of ball 72 and the center C of the club 71 face minus the radius of ball 72 and the velocity of the center of club face, the time is calculated that it would take the last position of the club face to contact the surface of ball 72. Knowing this time, the position of the three club head 126 markers 128*a–c* can be calculated assuming the velocity of face remains constant up until it reaches position C when impacting ball 72. With these club face positions calculated at impact, the position of ball 72 relative to the center of the club face can be calculated by finding the point of intersection of a line through the center of ball 72 and the normal to club face plane found by using the three extrapolated club points 128*a–c*.

The path angle and attack angle are found from the components of velocity measured at the center of the face $(V_x, V_y, V_z)$. They are defined as follows:

$$\text{Path Angle} = \tan^{-1}(V_x/V_z) \quad \text{(Eq.15)}$$

$$\text{Attack Angle} = \tan^{-1}(V_y/\sqrt{[V_x^2 = V_z^2]}) \quad \text{(Eq.16)}$$

With the automatic location of club velocity, path angle, attack angle and face hit location, the golfer receives quantitative information on his swing for teaching and club fitting purposes. In addition, the direction of the club face plane can be calculated at impact.

EXAMPLE

After calibration a described above a golfer swung an iron through field-of-view striking balls 72. The following data was obtained:

TABLE 1

Club Monitor Data

| Parameter | Measurement |
|---|---|
| Club head speed perpendicular to intended line of flight of ball (mph) | 100.1 |
| Loft Angle (degrees) | 19.2 |
| Attack Angle (degrees) | 3.8 Down |
| Path Angle (degrees) | 2.1 In-to-Out |
| Face Angle (degrees) | 3.4 Open |
| Droop angle (degrees) | −3.7 |
| Loft Spin (rpm) | 159 |
| Face Spin (rpm) | 333 |
| Droop Spin (rpm) | 87 |
| Hit-Vertical (inches) | .14 below geometric center |
| Hit-Horizontal (inches) | .31 from geometric center toward heel |

Based on the information in Table 1, the golfer should be advised to swing the golf club higher and to close the golf club face sooner before impact.

Additional data that is useful to the operator that can be obtained is the distance of the club head from the ball at position B. If this distance is zero or less than zero, it means the club head has contacted the ball at position B and thus the measurements do not reflect true velocity and should be retaken.

Referring to FIGS. 1 and 10, after the club head is swung and impacts the ball the ball monitor 16 is triggered when a sound trigger from the club hitting the golf ball is sent via microphone 122 to the system. The strobe light unit within the ball monitor 14 is activated causing a first image to be recorded by both cameras BC1, BC2 at position D in FIG. 10. There is an intervening, predetermined time delay, preferably 800 microseconds, before the strobe light flashes again and a second image of the ball is captured by cameras BC1 and BC2 at position D. The images from the markers 128*a–c* on the screen are shown as markers 134*a'-f'* in FIGS. 13 and 14.

The time delay is limited on one side by the ability to flash the strobe light and on the other side by the field-of-view. If the time delay is too long, the field-of-view may not be large enough to capture the golf ball in the cameras' views for both images. The cameras used in the systems 10 and 100 allow for both images (which occur during the first and the second strobe flashes) to be recorded in one image frame. Because the images are recorded when the strobe light flashes (due to reflections from the retro-reflective material on the golf ball), the flashes can be as close together as needed without concerns for the constraints of a mechanically shuttered camera.

Figure 14:
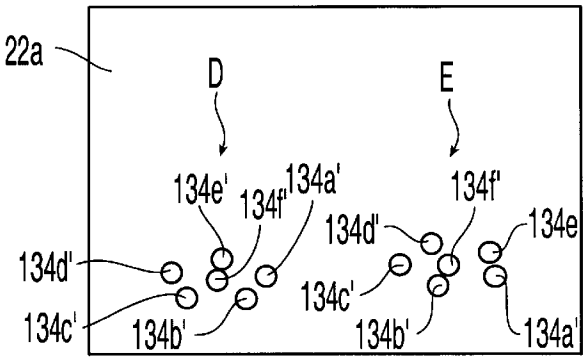
FIG. 14 is a front view of the monitor screen showing the image obtained by a second ball camera of the ball monitor.

This sequence produces an image of the reflections of light off of the retro-reflective markers on each light sensitive panel of the cameras and is shown in the monitor from camera BC1 in FIG. 13 and BC2 in FIG. 14. The location of the markers in each of the images are preferably determined with the RLE technique which was discussed for the calibration fixture.

Figure 17:
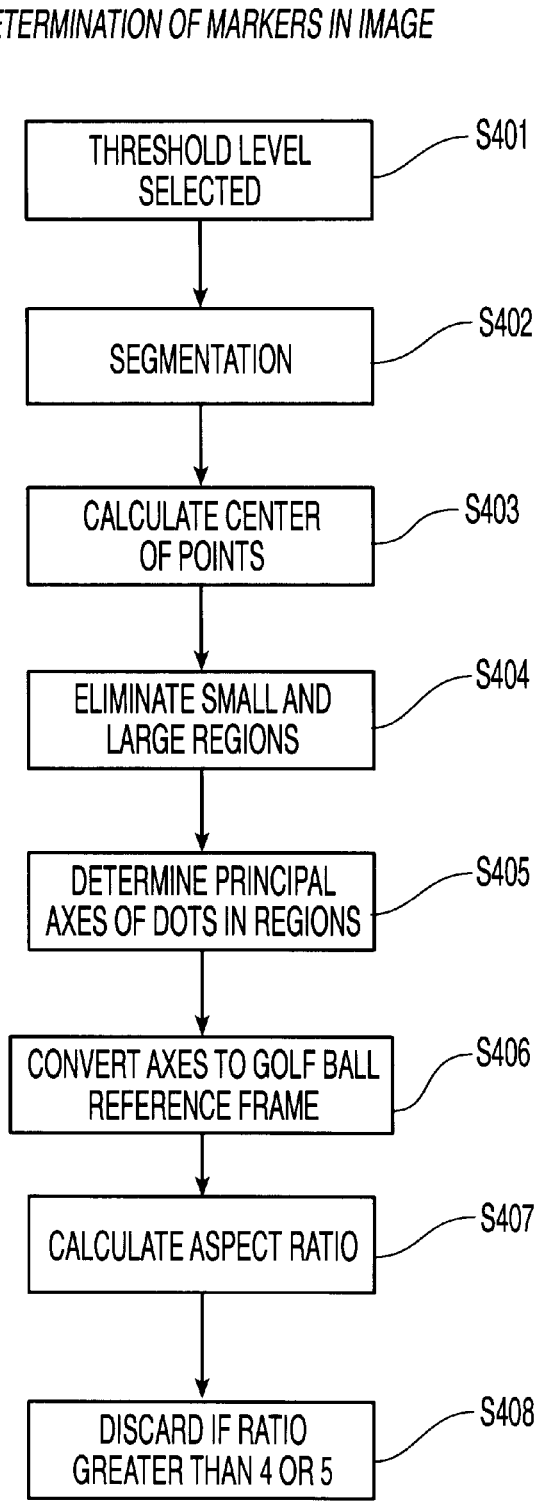
FIG. 17 is a flow chart describing the determination of markers in images.

The technique used for determining the aspect ratio to determine which bright areas are markers will now be described in conjunction with FIG. 17. As shown in step S401, the image must have an appropriate brightness threshold level chosen. By setting the correct threshold level for the image to a predetermined level, all pixels in the image are shown either as black or white. Second, at step S402, the images are segmented into distinct segments, corresponding to the bright areas in each of the images. The system, at step S403, determines the center of each area by first calculating the following summations at each of the segments using the following equations:

$$S_x=\Sigma X_i \quad \text{(Eq. 17)}$$

$$S_{xx}=\Sigma X_i^2 \quad \text{(Eq. 19)}$$

$$S_{yy}=\Sigma Y_i^2 \quad \text{(Eq. 20)}$$

$$S_{xy}=\Sigma X_i Y_i \quad \text{(Eq. 21)}$$

Once these sums, which are the sums of the bright areas, have been accumulated for each of $$S_y=\Sigma Y_i \quad \text{(Eq. 18)}$$

the segments in the image, the net moments about the x and y axes are calculated using the following equations:

$$I_x = S_{xx} - \frac{S_x^2}{\text{AREA}} \quad \text{(Eq. 22)}$$

$$I_y = S_{yy} - \frac{S_y^2}{\text{AREA}} \quad \text{(Eq. 23)}$$

-continued $$I_{xy} = S_{xy} - \frac{S_x S_y}{\text{AREA}} \quad \text{(Eq. 24)}$$

where AREA is the number of pixels in each bright area.

At step S404, the system eliminates those areas of brightness in the image that have an area outside a predetermined range. Thus, areas that are too large and too small are eliminated. In the preferred embodiment, the markers on the golf ball are ¼"-⅛" and the camera has 753×244 pixels, so that the markers should have an area of about 105 pixels in the images. However, glare by specular reflection, including that from the club head and other objects, may cause additional bright areas to appear in each of the images. Thus, if the areas are much less or much more than 105 pixels, then the system can ignore the areas since they cannot be a marker on the golf ball.

For those areas that remain (i.e., that are approximately 105 pixels) the system determines which are the correct twelve in the following manner. The system assumes that the markers will leave an elliptical shape in the image due to the fact that the markers are round and the golf ball's movement during the time that the strobe light is on. Therefore, at step S405 the system then calculates the principal moments of inertia of each area using the following equations:

$$I_{x'} = \frac{I_x + I_y}{2} + \sqrt{\left(\frac{I_x - I_y}{2}\right)^2 + I_{xy}^2} \quad \text{(Eq. 25)}$$

$$I_{y'} = \frac{I_x + I_y}{2} - \sqrt{\left(\frac{I_x - I_y}{2}\right)^2 + I_{xy}^2} \quad \text{(Eq. 26)}$$

These moments are converted to the golf ball reference frame in step 406. Finally, at step S407 the aspect ratio is calculated using the following equation:

$$R = \frac{I_{x'}}{I_{y'}} \quad \text{(Eq. 27)}$$

and the marker is rejected at step S408 if the aspect ratio is greater than four or five.

Returning to FIG. 15, once the locations of the markers are determined, the system computes the translational velocity of the center of the golf ball and angular velocity (spin rate) of the golf ball at step S107 in the following manner. First, the system uses the triangulation from the data of cameras to locate the position of the six markers on the surface of the golf ball. Specifically, the system solves the set of four linear equations shown below to determine the position (x,y,z) in the golf ball's coordinate system of each marker on the surface of the golf ball.

$$(D_{9,1}U^1-D_{1,1})x+(D_{10,1}U^1-D_{2,1})y+(D_{11,1}U^1-D_{3,1})z+(U^1-D_{4,1})=0 \quad \text{(Eq.28)}$$

$$(D_{9,1}V^1-D_{5,1})x+(D_{10,1}V^1-D_{6,1})y+(D_{11,1}V^1-D_{7,1})z+(V^1-D_{8,1})=0 \quad \text{(Eq.29)}$$

$$(D_{9,2}U^2-D_{1,2})x+(D_{10,2}U^2-D_{2,2})y+(D_{11,2}U^2-D_{3,2})z+(U^2-D_{4,2})=0 \quad \text{(Eq.30)}$$

$$(D_{9,2}V^2-D_{5,2})x+(D_{10,2}V^2-D_{6,2})y+(D_{11,2}V^2-D_{7,2})z+(V^2-D_{8,2})=0 \quad \text{(Eq.31)}$$

where $D_{ij}$ are the eleven constants determined by the calibration method at steps S102 and S306 (FIG. 16), where i identifies the constant and j identifies the image.

Next, the system converts the marker locations (determined at step S306 in FIG. 16) in the golf ball coordinate system to the reference global system of the calibrated cameras BC1, BC2 using the following matrix equation:

$$\begin{bmatrix} x_g \\ y_g \\ z_g \end{bmatrix} = \begin{bmatrix} T_x \\ T_y \\ T_z \end{bmatrix} + \begin{bmatrix} M_{11} M_{12} M_{13} \\ M_{21} M_{22} M_{23} \\ M_{31} M_{32} M_{33} \end{bmatrix} \begin{bmatrix} x_b \\ y_b \\ z_b \end{bmatrix} \quad \text{(Eq. 32)}$$

where Xg, Yg, Zg are the global coordinates of the center of the golf ball. The column vector, $T_x,T_y,T_z$, is the location of the center of the golf ball in the global coordinate system. The matrix elements $M_{ij}(i=1,3;j=1,3)$ are the direction cosines defining the orientation of the golf ball coordinate system relative to the global system. The three angles $a_1,a_2,a_3$ describe the elements of matrix $M_{ij}$ in terms of periodic functions. Substituting matrix equation for the global position of each reflector into the set of four linear equations shown above, a set of 28 equations result for the six unknown variables ($T_x,T_y,T_z,a_1,a_2,a_3$). A similar set of 28 equations must be solved for the second image of the golf ball. Typically, the solution of the three variables $T_x,T_y,T_z$ and the three angles at $a_1,a_2,a_3$ that prescribed the rotation matrix M is solvable in four iterations for the 28 equations that must be simultaneously satisfied.

The kinematic variables, three components of translational velocity and three components of angular velocity in the global coordinate system, are calculated from the relative translation of the center of mass and relative rotation angles that the golf ball makes between its two image positions.

The velocity components of the center of mass $V_x,V_y,V_z$ along the three axes of the global coordinate system are given by the following equations:

$$V_x = \frac{T_x(t+\Delta T) - T_x(t)}{\Delta T}; \quad \text{(Eq. 33)}$$

$$V_y = \frac{T_y(t+\Delta T) - T_y(t)}{\Delta T}; \quad \text{(Eq. 34)}$$

$$V_z = \frac{T_z(t+\Delta T) - T_z(t)}{\Delta T} \quad \text{(Eq. 35)}$$

(Eqs. 33, 34, and 35, respectively) in which t is the time of the first strobe measurement of $T_x,T_y,T_z$ and $\Delta T$ is the time between images.

The spin rate components in the global axis system result from obtaining the product of the inverse orientation matrix, $M^T(t)$ and $M(t+\Delta T)$. The resulting relative orientation matrix, A, $A(t,t+\Delta t)=M(t+\Delta t)M^T(t)$, measures the angular difference of the two strobe golf ball images.

The magnitude $\Theta$ of the angle of rotation about the spin axis during the time increment $\Delta T$ is given by equation Eq. 11. The three orthogonal components of spin rate, $W_x,W_y,W_z$ are given by the equation Eqs. 12–14.

At step S109 of FIG. 15, the system, including a computer algorithm, then computes the trajectories for the tests using the initial velocity and initial spin rate which were computed in step S107. For each time increment, the system interpolates the forces on the golf ball at time T and calculates the velocity at time T+1 from the velocity of the golf ball and the forces on the golf ball at time T. Next, the system computes the mean velocity and the Reynold's number, which is the ratio of the flow's inertial forces to the flow's viscous forces during the time interval from time T to time T+1. The system then interpolates the mean forces, from which the system calculates the velocity at time T+1. The forces include the drag force, the lift due to the spin of the golf ball, and gravitational forces. Using the velocity at time T+1, the system can compute the position at time T+1. Finally, the system computes the spin rate at time T+1. In the preferred embodiment, the length of the time interval is 0.1 seconds. This calculation is performed until the golf ball reaches the ground.

The system uses the equations in U.S. application Ser. No. 09/156,611 to perform these calculations. Accordingly, the system computes the total distance from the tee to the final resting position of the golf ball. A data file stores the results computed by the trajectory method.

Referring again to FIG. 15, the system then determines whether an additional test will be performed. If additional tests are to be performed, the process described above repeats, beginning at step S104 with the sound trigger through step S110 where the trajectory method computes and presents the trajectory for the golf ball.

When all tests have been performed, the analysis method computes statistics for each golf ball type used in the tests and presents the results to the operator. For the group of tests performed for each golf ball type, the system computes the average value and standard deviation from the mean for several launch characteristics including the velocity, the launch angle, the side angles, the backspin, the side spin, and the carry and roll.

Different factors contribute to the standard deviation of the measurements including the variation in the compression and resilience of the golf balls, the variation in the positioning of the markers on the golf balls, the pixel resolution of the light sensitive panels and the accuracy of the pre-measured markers on the calibration fixture. Obviously, the primary source of scatter lies in the swing variations of the typical golfer.

Upon request from the operator, the system will display the test results in various forms. For example, the system will display individual results for the golf ball type selected by the operator. The following table shows sample data obtained during the same swing as the club head data obtained in Table 1:

TABLE 2

Ball Monitor Data

| Parameter | Measurement |
|---|---|
| Speed of Ball (mph) | 139.7 |
| Launch Angle (degrees) | 14.4 |
| Backspin (rpm) | 5512 |
| Side Angle (degrees) | .7 Push |
| Side Spin (rpm) | 1135 Slice |
| Rifling Spin (rpm) | 682 |
| Carry Distance (yards) | 203.5 |
| Deviation (yards) - the distance and direction the ball deviates from a straight flight path | 25.0 Right |
| Carry and Roll Distance (Yards) | 215.0 |

Based on the information in Table 2, the golfer should be advised to close the club face more at impact to avoid the slice and to swing in-to-out so to avoid a push.

Similarly, the system in step S113 can also display tabular representations of the trajectories for the golf ball types selected by the operator. The tabular representation presents trajectory information including distance, height, velocity, spin, lift, drag, and the Reynold's number. Similarly, the analysis method displays graphical representation of the trajectories for the golf ball types selected by the operator. The system computes the graphical trajectories from the average launch conditions computed for each golf ball type.

At step S113, the system displays the average of each of the shots taken by the golfer. The results are displayed in a tabular and/or graphical format. The displayed results include the total distance, the spin rate, the launch angle, distance in the air, and golf ball speed. From this information, the system at step S114 shows the golfer the results if the launch angle and spin rate of the golf ball were slightly changed, allowing the golfer to optimize the equipment and/or swing. Results could also be changed and displayed based on changes in the club speed and angles.

At step S114, the system calculates the distances of a golf ball struck at a variety of launch angles and spin rates that are close to those for the golfer. The operator is able to choose which launch angles and spin rates are used to calculate the distances. In order to display this particular data, the system performs the trajectory calculations described above between about 50–100 times (several predetermined values of launch angles and several predetermined values of initial spin rates). The operator can dictate the range of launch angles and spin rates the system should use, as well as how many values of each the system uses in the calculations. From the graphical data (*), the golfer can determine which of these two variables could be changed to improve the distance.

Since the golfer's data is saved, when the system is in the test mode, it is also possible to compare the golfer's data with that of other golfers, whose data were also saved. In this way, it is possible for golfers to have their data (launch angle, initial golf ball speed, spin rate, etc.) compared to others. This comparison may be done in a tabular or graphical format. Similarly, the system may compare the data from successive clubs (e.g., a 5-iron to a 6-iron to a 7-iron) to determine if there are gaps in the clubs (inconsistent distances between each of the clubs). Alternatively, two different golfers could be compared using the same or different clubs, or the same or different balls.

The club cameras can include filters of a different color from filters on the ball camera. For example, the club cameras can include different color filters and the club and ball can include different colored markers. The net effect should be that the club cameras record images of the markers on the club and ball and the ball cameras record only images of the markers on the ball not the club. Alternatively to using different color filters and markers, dimmer markers can be used on the club with a strong strobe light in the club monitor and brighter markers can be used on the ball with a weak strobe light in the ball monitor. The net result, will be the same as with the colored filters and balls (i.e., the club image has club and ball markers and the ball image has only ball markers).

While the above invention has been described with reference to certain preferred embodiments, it should be kept in mind that the scope of the present invention is not limited to these embodiments. The system can also be set up to measure the golfer's swing during the back swing, down swing and/or both. The system is shown with two club cameras and two ball cameras, a single club camera and a single ball camera can be used but accuracy of the measurements decreases with only two cameras. The single club and ball camera system can be used with any of the lighting arrangements discussed above, such as with dual adjacent strobe lights. The embodiments above can also be modified so that some features of one embodiment are used with the features of another embodiment. One skilled in the art may find variations of these preferred embodiments which, nevertheless, fall within the spirit of the present invention, whose scope is defined by the set forth below.

We claim:

1. A launch monitor system for measuring data for a club and a ball moving in a predetermined field-of-view, the system comprising: at least one club camera pointed toward the predetermined field-of-view, and positioned in a first plane, each club camera obtains at least two club images in the predetermined field-of-view; at least one ball camera pointed toward the predetermined filed-of-view, and positioned in a second plane spaced vertically from the first plane, each ball camera obtains at least two ball images in the predetermined field-of-view; and a computer to determine club motion data from the club images and ball motion data from the ball images.

2. The launch monitor system of claim 1, wherein the first plane is spaced vertically above the second plane.

3. The launch monitor system of claim 2, further including at least two ball cameras, each camera taking at least one image of the ball.

4. The launch monitor system of claim 3, further including at least one second sensor for activating each ball camera to obtain the images of the ball after the club impacts the ball during a swing.

5. The launch monitor system of claim 4, wherein the club motion data is at least three-dimensional.

6. The launch monitor system of claim 4, wherein the ball motion data is at least three-dimensional.

7. The launch monitor system of claim 1, further including at least two club cameras, each camera taking at least one image of the club.

8. The launch monitor system of claim 1, further including at least one strobe light associated with each of the club and ball cameras.

9. The launch monitor system of claim 1, further including at least one first sensor for activating each club camera to obtain the first image of the club before the club impacts the ball during a swing.

10. The launch monitor system of claim 1, wherein the club motion data is at least two-dimensional.

11. The launch monitor system of claim 1, wherein the ball motion data is at least two-dimensional.

12. The launch monitor system of claim 1, wherein the club includes at least two contrasting areas thereon.

13. The launch monitor system of claim 1, wherein the club further includes a head, a hosel, a shaft, a first contrasting area on the head, a second contrasting area on the hosel, and a third contrasting area on the shaft.

14. The launch monitor system of claim 1, wherein the ball includes at least one contrasting area thereon.

15. The launch monitor system of claim 1, wherein the ball includes six contrasting areas thereon.

16. The launch monitor system of claim 1, wherein the club images include an image of the ball on a tee.

17. A launch monitor system for measuring data for a club and a ball moving in a predetermined field-of-view, the system comprising: at least one club camera pointed toward the predetermined field-of-view, each club camera obtains at least two club images in the predetermined field-of-view; at least one ball camera pointed toward the predetermined filed-of-view, each ball camera obtains at least two ball images in the predetermined field-of-view; each of the club and ball cameras are located on the same side of the club and ball, and a computer to determine club motion data from the club images and ball motion data from the ball images.

18. The launch monitor system of claim 17, wherein the club includes at least two contrasting areas thereon and the ball includes at least one contrasting area thereon, and the club images include at least all of the club contrasting areas and the ball images include at least all of the ball contrasting areas.

19. A method of calculating club motion data and ball motion data using a launch monitor system, said method comprising the steps of: a golfer swinging a club to impact a ball; obtaining at least two club images during the swing at two different times; obtaining at least two ball images at two different times during the swing; determining the club motion data from the club images; and determining the ball motion data from the ball images; wherein the club images are obtained before the club impacts the ball and the ball images are obtained after the club impacts the ball during a swing.

20. A method of claim 19, wherein the step of determining the club motion data includes determining at least one of the following: speed, acceleration, loft angle, attack angle, path angle, face angle, droop angle, loft spin, face spin, droop spin, and hit location.

21. A method of claim 19, wherein the step of determining the ball motion data includes determining at least one of the following: velocity, launch angle, backspin, side angle, side spin rifling spin, carry distance, direction, and carry and roll distance.

22. The method of claim 19, wherein each club image is obtained during a downswing.

23. The method of claim 19, wherein each club image is obtained during a back swing.

* * * * *